US010273747B2

(12) United States Patent
Hall et al.

(10) Patent No.: US 10,273,747 B2
(45) Date of Patent: Apr. 30, 2019

(54) WINDOW COVERING WITH HYBRID SHADE-BATTERY

(71) Applicants: David R. Hall, Provo, UT (US); Emily Brimhall, Alpine, UT (US); Jedediah Knight, Provo, UT (US)

(72) Inventors: David R. Hall, Provo, UT (US); Emily Brimhall, Alpine, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 11 days.

(21) Appl. No.: 15/481,991

(22) Filed: Apr. 7, 2017

(65) Prior Publication Data

US 2018/0291676 A1 Oct. 11, 2018

(51) Int. Cl.

| | |
|---|---|
| ***E06B 9/24*** | (2006.01) |
| ***E06B 9/32*** | (2006.01) |
| ***E06B 9/42*** | (2006.01) |
| ***E06B 9/72*** | (2006.01) |
| ***E06B 9/326*** | (2006.01) |
| ***E06B 9/386*** | (2006.01) |

(52) U.S. Cl.

CPC ..... *E06B 9/24* (2013.01); *E06B 9/32* (2013.01); *E06B 9/326* (2013.01); *E06B 9/386* (2013.01); *E06B 9/42* (2013.01); *E06B 9/72* (2013.01)

(58) Field of Classification Search

CPC . E06B 9/322; E06B 9/323; E06B 9/72; E06B 9/68; E06B 9/70; E06B 9/74; E06B 9/386; E06B 2009/2476

See application file for complete search history.

(56) References Cited

U.S. PATENT DOCUMENTS

| | | | | |
|---|---|---|---|---|
| 7,264,034 | B2 * | 9/2007 | Lin | E06B 9/32 160/168.1 P |
| 9,722,220 | B2 * | 8/2017 | Lemaitre | E06B 9/72 |
| 2003/0168188 | A1 * | 9/2003 | Wen | E06B 9/308 160/168.1 P |
| 2004/0123960 | A1 * | 7/2004 | Jorgensen | E06B 9/40 160/310 |
| 2007/0175599 | A1 * | 8/2007 | Froese | E06B 9/386 160/168.1 R |
| 2010/0154999 | A1 * | 6/2010 | Oh | E06B 9/322 160/7 |
| 2012/0255689 | A1 * | 10/2012 | Blair | E06B 9/32 160/331 |

(Continued)

*Primary Examiner* — Brian D Mattei

(57) ABSTRACT

Embodiments of motorized window coverings are described herein that may include a covering portion, a top portion, a bottom portion, and wiring. The top portion may comprise a deploying mechanism and a motor. The deploying portion may deploy the covering portion, and the covering portion may be directly connected to the deploying mechanism. The motor may operate the deploying mechanism. The bottom portion may be directly connected to the covering portion at an opposite end of the motorized window covering from the top portion. One or more batteries may be integrated into the covering portion. The batteries may power the motor. Wiring may be disposed in the covering portion. The wiring may electrically couple the motor to the one or more batteries. In some embodiments, the motorized window covering may include a roller shade and/or a venetian blind.

20 Claims, 19 Drawing Sheets

(56) References Cited

U.S. PATENT DOCUMENTS

| | | | | |
|---|---|---|---|---|
| 2013/0284234 | A1* | 10/2013 | Funayama | H01L 31/045 136/245 |
| 2014/0224434 | A1* | 8/2014 | Gross | E06B 9/42 160/127 |
| 2015/0179994 | A1* | 6/2015 | Lemaitre | E06B 9/72 160/310 |
| 2015/0288316 | A1* | 10/2015 | Hall | F16H 57/021 318/434 |
| 2015/0373831 | A1* | 12/2015 | Rogers | H01L 23/18 429/121 |
| 2017/0167193 | A1* | 6/2017 | Slivka | E06B 9/42 |
| 2017/0204658 | A1* | 7/2017 | Kin | E06B 9/322 |
| 2017/0234066 | A1* | 8/2017 | Graybar | E06B 9/322 475/149 |
| 2017/0298690 | A1* | 10/2017 | Mullet | E06B 9/40 |
| 2018/0112463 | A1* | 4/2018 | Derk, Jr. | E06B 9/72 |
| 2018/0135351 | A1* | 5/2018 | Walker | E06B 9/264 |
| 2018/0202224 | A1* | 7/2018 | Kumar | E06B 9/44 |

* cited by examiner

WINDOW COVERING WITH HYBRID SHADE-BATTERY

CROSS-REFERENCES

This application makes reference to U.S. Pat. No. 9,540,817 to David R. Hall et al., entitled "Motorized Gearbox Assembly with Through-Channel Design," which is incorporated herein by reference in entirety. This application also makes reference to "A hybrid solid electrolyte for flexible solid-state sodium batteries" by Kim, et al. in *Energy & Environmental Science,* 2015, vol. 8, pages 3589-3596; and "A flexible solid-state electrolyte for wide-scale integration of rechargeable zinc-air batteries" by Fu, et al. in *Energy & Environmental Science,* 2016, vol. 9, pages 663-670, which articles are incorporated herein by reference in entirety.

TECHNICAL FIELD

This invention relates generally to the field of window coverings and more specifically to motorized window coverings.

BACKGROUND

Many window blinds and shades are becoming motorized. This presents new problems in the design of such devices. One such problem includes powering the motor. Some solutions include using batteries. Some batteries are disposed outside the window covering, such as outside the headrail or tube. However, this presents aesthetic problems, as well as problems exposing the battery to environmental conditions. Some manufacturers have placed batteries inside the headrail or tube. Unfortunately, access to the batteries is still a challenge. In some cases, the window blind or shade must be removed to replace the batteries. In some roller shade cases, the shade must be completely unrolled and the tube exposed to remove and replace the batteries. This can be problematic if the batteries are completely dead, and can be inconvenient whether the batteries are dead or not. Thus, there is still room for improvement.

SUMMARY OF THE INVENTION

Embodiments of motorized window coverings are described herein that address at least some of the issues described above in the Background. Various embodiments may include a covering portion, a top portion, a bottom portion, and wiring. The top portion may comprise a deploying mechanism and a motor. The deploying portion may deploy the covering portion, and the covering portion may be directly connected to the deploying mechanism. The motor may operate the deploying mechanism. The bottom portion may be directly connected to the covering portion at an opposite end of the motorized window covering from the top portion. One or more batteries may be integrated into the covering portion between an upper end and a lower end opposite the upper end. The batteries may power the motor. Wiring may be disposed in the covering portion. The wiring may electrically couple the motor to the one or more batteries. In some embodiments, the deploying mechanism may include a roller tube supported by one or more mounting brackets, and the covering portion may include a flexible shade connected to the tube that rolls on and off the tube. In some embodiments, the top portion may include a headrail, the deploying mechanism may include a tilt rod disposed within the headrail, and the covering portion may include one or more window blind slats coupled to the tilt rod.

BRIEF DESCRIPTION OF THE DRAWINGS

A more particular description of the apparatus and/or system summarized above is made below by reference to specific embodiments. Several embodiments are depicted in drawings included with this application, in which.

DETAILED DESCRIPTION

Figure 1:
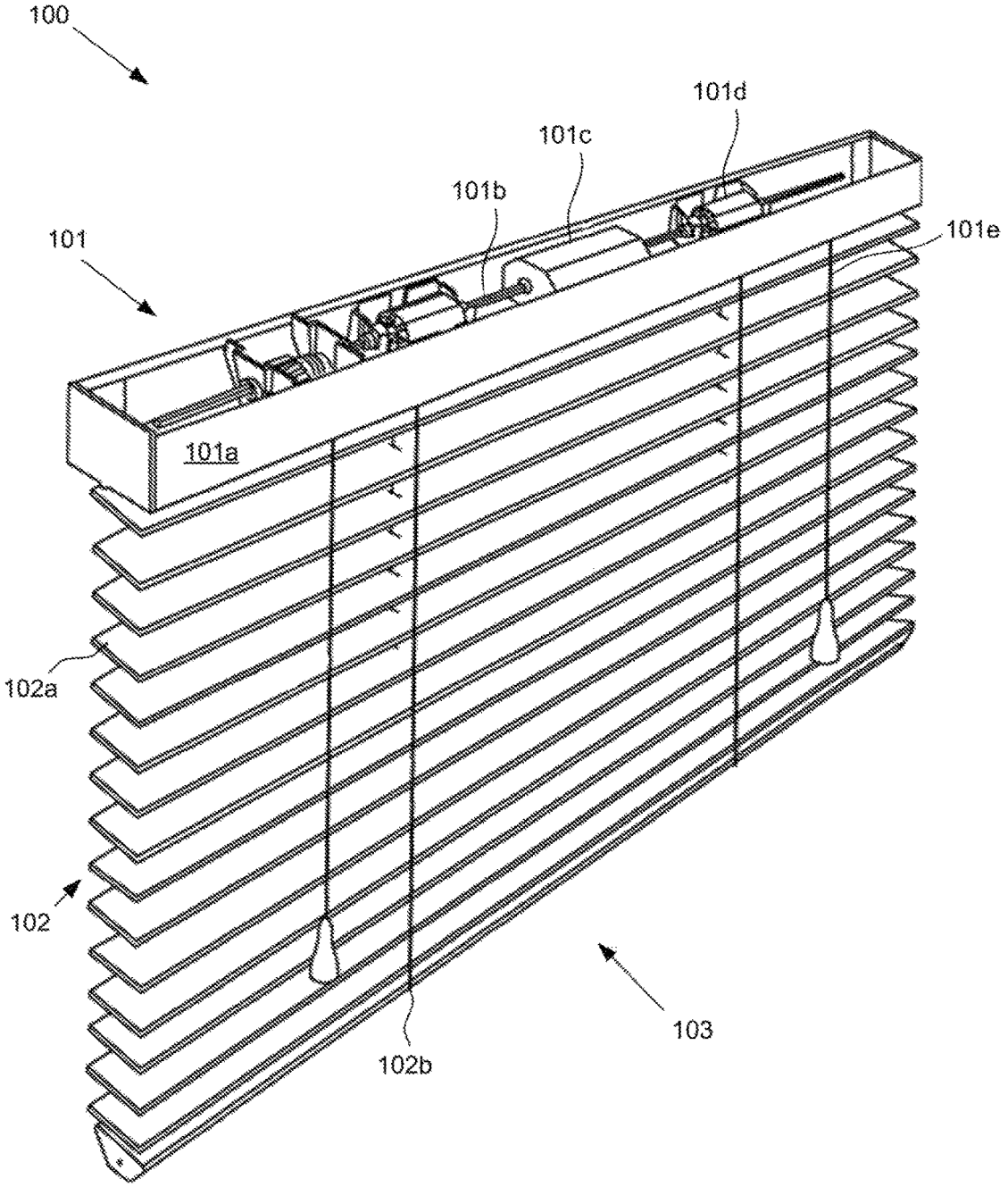
FIG. 1 depicts a venetian blind.

A detailed description of embodiments of an apparatus and/or system is provided below by example, with reference to embodiments in the appended figures. Those of skill in the art will recognize that the features of the apparatus as described by example in the figures below could be arranged and designed in a wide variety of different configurations. Thus, the detailed description of the embodiments in the figures is merely representative of embodiments of the invention, and is not intended to limit the scope of the invention as claimed.

Embodiments of motorized window coverings are described herein. Various embodiments may include a covering portion, a top portion, a bottom portion, and wiring. The top portion may comprise a deploying mechanism and a motor. The deploying mechanism may deploy the covering portion, and the covering portion may be directly connected to the deploying mechanism. The motor may operate the deploying mechanism. The bottom portion may be directly connected to the covering portion at an opposite end of the motorized window covering from the top portion. One or more batteries may be integrated into the covering portion. The batteries may power the motor. Wiring may be disposed in the covering portion. The wiring may electrically couple the motor to the one or more batteries.

In some specific embodiments, the motorized window covering may be embodied as a motorized roller shade. The top portion may include one or more mounting brackets. The deploying mechanism may include a roller tube supported by the one or more mounting brackets. A motor may be disposed within the tube and fixed to at least one of the one or more brackets. The covering portion may include a flexible shade connected to the tube that rolls on and off the tube. The flexible shade may include a battery integrated into the flexible shade. The wiring may be disposed in the flexible shade, and may electrically couple the battery to the motor.

In some specific embodiments, the motorized window covering may be embodied as a motorized blind system. The top portion may include a headrail. The headrail may include a housing and one or more mounting brackets. The deploying mechanism may include a tilt rod disposed within the headrail, such as within the housing. A motor may be disposed in, and fixed to, the headrail. For example, the motor may be disposed within the housing and fixed to the housing and/or the mounting brackets. The motor may be connected to the tilt rod. The covering portion may include one or more window blind slats coupled to the tilt rod. At least one of the slats may include a battery integrated into the at least one slat. The wiring may pass through the one or more window blind slats and may electrically couple the battery to the motor.

Embodiments of the motorized window covering may include various types of interior and/or exterior window coverings. Such window coverings may include blinds, shutters, shades and/or drapes. Specific embodiments may include slat blinds, venetian blinds, vertical blinds, roman blinds, mini blinds, micro blinds, louvers, jalousies, brise soleil, pleated blinds, interior shutters, plantation shutters, café shutters, roller shades, cellular shades, roman shades, pleated shades, bamboo shades, sheer shades, curtains, drapes, and/or valances, among others.

The covering portion may comprise any of a variety of structures and/or materials. In general, the covering portion may comprise a shade. The shade may have an upper end and a lower end opposite the upper end. In various embodiments, the covering portion may include rigid slats and/or a flexible panel. The covering portion may be formed of wood, aluminum, bamboo, vinyl, one or more synthetic polymers, fabric, cotton, polyester, nylon, polyethylene, polyvinylidene chloride, LDPE, or combinations thereof. The wiring may be incorporated into the covering portion in a variety of ways. For example, the covering portion may include a flexible panel, and the wiring may be integrated into the flexible panel. The flexible panel may be comprised of a woven material, such as a woven fabric, and the wiring may be woven into the flexible woven panel similar to how strands forming the woven panel are woven together. The wiring may include one or more wires, each wire having a thickness equal to the thickness of one woven strand plus or minus 50% of the thickness of the strand. The wires may include non-conductive sheathing, and may be woven into the fabric. Such may be accomplished by alternating one or more bobbins of wire with bobbins of strands. In some embodiments, the flexible panel may for comprised of one or more layers of thermoformed polymer material. In some embodiments, the wiring may be pressed between two layers of polymer heated above the polymer's glass transition temperature. In other embodiments, the wiring may be pressed into a single layer of heated polymer. In some embodiments, the covering portion may include one or more strings connected to the deploying portion. The strings may include the wiring. For example, the wiring may be interwoven with strands that form the strings.

The top portion may correspond to a variety of different window covering types. The top portion may include a headrail, the deploying mechanism, and/or one or more mounting brackets. In general, the top portion may include a rotatable element connected to the shade/covering portion that rotates to deploy and retract the shade/covering portion. The deploying mechanism may include a roller tube and/or a tilt rod. The deploying portion may be comprised of one or more materials, including wood, aluminum, steel, carbon fiber, fiberglass, PVC, ABS, and/or combinations thereof, among others. The deploying portion may be connected to the covering portion, such as by one or more strings, cords, glue, tape, rivets, and/or pins, among other means. The mounting brackets may mount the top portion to a mounting surface, such as a wall and/or window frame. For example, the mounting brackets may include one or more rigid plates having openings through which screws may be passed into the mounting surface. The mounting brackets may include one or more various slots, channels, grooves, clips and/or latches, and may include detachable segments. For example, a first segment may be affixed to the mounting surface and a second segment may be affixed to the top portion of the window covering. The first and second segments may detachably connect to each other.

As used herein, the "motor" may refer generally to a motor and gear assembly. The motor may rotate the rotatably element. The motor may include various components, including a stator, a rotor, a transmission, and/or a control unit. The stator may be fixed to a fixed segment of the top portion, such as a headrail and/or a mounting bracket. The rotor may be rotatably connected to the stator. The transmission may be transmissively coupled to the rotor to transmit rotation of the rotor to a rotatable element of the top portion. The rotatable element may include a tilt rod. In such embodiments, the transmission may include a gear assembly including one or more stages of gears that reduce the number of rotations of the motor and translate the reduction to rotations of the tilt rod. The gear assembly may include a through-channel, and the tilt rod may pass through the through-channel. In some embodiments, the rotatable element may include a tube. The motor may be disposed within the tube. The transmission may include a planetary set of gears engaged with an interior surface of the tube. The planetary gears may include one or more stages that reduce the number of rotations of the motor and translate the reduction to rotations of the tube.

The control unit may include hardware memory, one or more hardware processors, and/or one or more transceivers. The hardware memory may store instructions that, when executed by the one or more processors, cause the stator to rotate the rotor and transmit the rotation of the rotor via the transmission to the deploying portion. The instructions may include various directions and/or durations of rotation. The instructions may include detecting hard stops of the deploying mechanism and storing positions of the deploying mechanism corresponding to the hard stops. Such may be accomplished, for example, using one or more position encoders. Such position encoders may include, for example, one or more diametrically magnetized magnets.

The battery that powers to the motor may be disposed in the covering portion, e.g. the shade, between the upper and lower ends. The one or more batteries may include primary and/or secondary batteries. In some embodiments, the one or more batteries may act as back-up batteries. In such embodiments, the motor may be primarily powered by mains electricity. The back-up batteries may store enough power to raise, lower, and/or tilt the covering portion 5-10 times while the power is out. In other embodiments, the one or more batteries disposed in the covering portion are the primary battery source for the motor. In such embodiments, the batteries may store enough power for thousands of iterations of the motor, and/or may be rechargeable.

The batteries may include various chemistries. In general, the battery may include an anode, a cathode, and an electrolyte. The battery/battery cells may be flexible or rigid. The electrolyte may include a solid-state electrolyte, a liquid electrolyte, or both. In some embodiments, the electrolyte comprises a flexible solid-state electrolyte. One example of a battery incorporating such an electrolyte is described in "A hybrid solid electrolyte for flexible solid-state sodium batteries" by Kim, et al. in *Energy & Environmental Science,* 2015, vol. 8, pages 3589-3596, which article is incorporated herein by reference in its entirety. Another example is described in "A flexible solid-state electrolyte for wide-scale integration of rechargeable zinc-air batteries" by Fu, et al. in *Energy & Environmental Science,* 2016, vol. 9, pages 663-670, which article is incorporated herein by reference in its entirety. The battery may have a voltage ranging from 0.1V to 12V, and may have a current capacity ranging from 0.1 mAh to 3600 mAh. The battery components may be disposed within a rigid and/or flexible polymer housing, the polymer having a rigidity corresponding with a Young's Modulus (YM) ranging from 0.01 GPa to 5 GPa for flexible materials and ranging from 4 GPa to 100 GPa, 10 GPa to 1000 GPa, or ranging greater than 1000 GPa. Similarly, the anode, cathode, and/or electrolyte may include materials having a range of rigidities. In some embodiments, one or more of the anode and the cathode are comprised of flexible materials. Such flexible materials may have high YMs, but may include crystal lattice arrangement, cellular arrangement, or relative length and thickness that may increase the flexibility perceived by a user. For example, one or more of the anode and the cathode may have a thickness ranging from 0.1 nm to 100 nm, and a length ranging from 10,000 nm to 100,000 nm. The battery may have a thickness ranging from 100 nm to 1,000 nm, and length/width dimensions ranging from 1 mm to 200 mm Flexibility of other materials and components described herein may be similarly manipulated.

The flexibility effect may be enhanced by cellularization of the battery. Flexible interstices may be formed in the covering portion between battery cells by materials having rigidities corresponding to YMs ranging from 0.01 GPa to 4 GPa. Individual battery cells may have a flexion-dimension ranging from 0.1 in to 3 in, with flexible interstices disposed between the flexion-dimensions of neighboring cells. The cells may have a high rigidity along the flexion-dimensions, whereas the interstices may be flexible. The optimal relationship between the flexion-dimension and the YM of the flexible interstice may be related by a dominant first-order coefficient or a dominant second-order coefficient, such that the length of the flexion-dimension decreases with a decreasing YM.

The wiring may be embodied in any of a variety of ways. For example, the covering portion may include one or more strings connecting vertical slats to the deploying portion. The strings may include the wiring, such as incorporating the wiring into at least one of the strings. Such may be accomplished by weaving the wiring into the one or more strings. In some embodiments, the wiring may include a set of individually sheathed wires, or sets of collectively sheathed wires. The sets of wires may be interwoven to form at least one of the strings. The coloring of the sheathing may correspond to a color scheme of the covering portion, such as the other strings, to camouflage the wiring in the covering portion. Additionally, the wiring may be disposed within the slats. Such may be accomplished by integrating the wiring during the thermoforming process, by drilling along the length of the slat and passing the wiring through the resulting opening, and or forming one or more grooves in a surface of the slat, placing the wiring in the grooves, and (in some cases) covering the wiring and the grooves with, for example, a vinyl wrap.

In some embodiments, the wiring may be integrated into the flexible shade. For example, the flexible shade may include one or more woven materials, and the wiring may be woven into the woven materials. As another example, the flexible shade may include one or more layers of thermoformed plastic. The wiring may be bonded to the plastic and/or pressed between two or more sheets of plastic during the thermoforming process. As yet another example, the flexible shade may include one or more polymer layers attached to each other by an adhesive. The wiring may be placed between the layers and adhered to the layers by the adhesive.

The wiring may have an ampacity ranging from 0.1 Amps to 20 Amps. The ampacity may correspond to individual wires of the wiring or the wiring collectively. In embodiments where the wiring includes one or more sets of wires, each wire of the set of wires may be electrically coupled to a monolithic conductor. The monolithic conductor may be disposed between the wiring and the motor. The monolithic conductor may be connected to the top portion and/or electrically coupled to the motor. A second monolithic conductor may be connected to the bottom portion. The monolithic conductors may aggregate current carried by the wires of the wiring and deliver the current from the batteries to the motor. The monolithic conductor may include a strip and/or wire formed of copper. In embodiments where the monolithic conductor is a wire, the monolithic conductor may have a gauge equal to the combined gauge of the wiring.

As described above, specific embodiments of the motorized window covering may include roller shade embodiments, the covering portion including a flexible shade that rolls onto a tube. The flexible shade may include a plurality of battery cells, each cell including the anode, the cathode, and the electrolyte. The cells may be interconnected by the wiring, either in parallel, in series, or combinations thereof, to create the necessary voltage and current conditions required to power the motor. The battery cells may be incorporated into the flexible shade in a variety of ways. In embodiments where the flexible shade includes woven materials, the batteries may be woven into the materials, and/or the flexible shade may include multiple inter-woven layers, with the battery/battery cells disposed between the woven layers. In embodiments where the flexible shade includes one or more polymer layers, the battery/battery cells may be adhered to one or more of the polymer layers by an adhesive, disposed between adhered layers, or molded into one or more of the layers. Molding the battery into the polymer material may, for example, be convenient with batteries having high heat tolerance and polymers having low glass transition temperature ranges. In general, such materials may have glass transition temperatures ranging from −100° F. to 140° F. In some embodiments, the battery may be disposed between two polymer layers that are heated to combine the layers into a single layer.

The shade may include segments having a first thickness and other segments having a second thickness. The first thickness may be thicker than the second thickness. The first thickness may range from 5 to 50 mils; the second thickness may range from 1 to 50 mils. At least one of the battery cells may be disposed in the flexible shade along the first thickness. At least one of the interstices, as described below, may be disposed in the shade along the second thickness.

The flexible shade may include one or more interstices disposed between the cells. Each interstice may be empty, or may include the polymer the flexible shade is formed of, and/or another polymer. Each interstice may have a width ranging from one-tenth a width of one of the plurality of cells to ten times the cell width. In some embodiments, the interstice width may be at least twice the cell width. The cells may be disposed horizontally adjacent to each other, vertically adjacent to each other, or both, where horizontal and vertical refer to directions relative to gravity as the window covering is mounted to a surface. The wiring may electrically couple vertically-adjacent cells, horizontally adjacent cells, or both. Varying between vertical and horizontal coupling may be required to accommodate enough batteries in the shade while still achieving the necessary power requirements for the motor. For example, the cells may be segmented into horizontally-coupled segments including a plurality of horizontally-coupled cells, with a plurality of such segments organized vertically, each horizontal segment connected vertically to each other horizontal segment. This may reduce the amount and complexity of the wiring. Additionally, the interstices may be disposed between horizontally-adjacent cells, vertically-adjacent cells, or both.

The flexible shade may have a first thickness corresponding to the battery thickness and a second thickness corresponding to the interstices. The first thickness may be thicker than the second thickness, or the first thickness may be the same as the second thickness. For example, the first thickness may range from 5 to 50 mils, where a portion of the thickness is attributable to the battery and a portion of the thickness is attributable to the other material forming the flexible shade. The second thickness may range from 1 to 50 mils. The variable thickness may address issues encountered during installation of the window covering. An installer may need to cut the flexible shade to fit it in a window frame or over some other architectural feature. The variable thickness may provide the installer with a guide of where interstices between batteries are so that the installer may cut the shade along the interstice and avoid cutting the battery/battery cells. Alternatively/additionally, the battery/battery cells may only occupy a segment of the flexible shade less than the whole of the flexible shade, which may allow for the non-battery segment to be cut-to-fit. This segment may include: a top segment, such as the top half, the top third, the top quarter, and/or the top fifth; a side segment, such as a half, a third, a quarter, and/or a fifth; a bottom segment, such as the bottom half, the bottom third, the bottom quarter, and/or the bottom fifth; or a center segment, such as half, a third, a quarter, and/or a fifth of the total area of the flexible shade. Additionally, the battery segment may be incorporated into the flexible shade in ranges between these portions, including one half to one third, one third to one quarter, one quarter to one fifth, one half to one quarter, one third to one fifth, one half to one fifth, and/or up to 90% of the flexible shade. However, not all embodiments may be cut; because of wiring requirements, in some embodiments, each flexible shade must be formed-to-fit.

As described above, specific embodiments of the motorized window covering may include blinds embodiments, the covering portion including a plurality of slats connected to a tilt rod by one or more strings. As described above, the wiring may be integrated into at least one of the one or more strings. At least one of the slats may have incorporated into it a battery and/or a plurality of battery cells, each cell comprising an anode, a cathode, and an electrolyte. The slat may include perforations in the slat that accommodate the strings. The perforations may be formed in the slat as the battery is incorporated into the slat. For example, the slat may be formed of two symmetrical half-segments of injection-molded plastic. The injection-molded plastic may include internal brackets that may be modified after the half-segments are formed to mount the battery/battery cells inside the slat. Such may be accomplished by, for example, forming the half-segments with a plurality of internal brackets and removing the unnecessary internal brackets. As the battery/battery cells are installed in the half-segments, positions for perforations through which the strings and wiring may pass may be chosen and formed.

In various embodiments, the slat containing the battery cells may include one or more interstices disposed between adjacent cells. The interstices may have a width between the adjacent cells at least equal to twice a diameter of a string connecting the slat to adjacent slats, the tilt rod or both. The slat may include one or more markings corresponding to each of the one or more interstices. The marking may indicate to a user a position of each interstice, a width of each interstice, or both. This configuration may allow for the battery cells to be integrated into the slat before it is known what width of the slat will be needed. The interstices may provide space along the slat for the installer to cut the slat and/or form perforations in the slat for the strings and/or wiring. In some such embodiments, each battery cell is connected by one or more conductive rods that pass across the interstices. The interstice may be cut, and the wiring may be soldered to the conductive rod.

In some embodiments, the battery/battery cells may be formed separately from the slat. A polymer housing and/or wrap may surround the battery/battery cells that imitates the design of the slats. The battery/battery cells may have a thickness and width equal to a thickness and width of the other slats, and a length equal to the other slats, or shorter than the other slats. One or more detachable end segments may connect to the battery/battery cells, extending from the battery/battery cells to extend the length of the slat to match the length of the other slats. For example, in one embodiment, the battery may be disposed in a center segment of the slat. The slat may include one or more detachable end segments extending from the center segment, such as one detachable end extending from each side of the center segment. In some embodiments, the extension segments may be detachable, and in other embodiments, the extension segments may be integrated with the battery segment. Seams between the extension segments and the battery segment may indicate a length limit that the slat may be cut down to.

The slat into which the battery is incorporated may be rigid. The rigidity of the slat may provide support and protection to the battery/battery cells. As such, in various embodiments, the rigidity may correspond to a YM greater than or equal to 5 GPa. The rigidity may be higher than the rigidity of non-battery slats, which may indicate to a user that the slat houses the battery/battery cells.

Specific embodiments of the motorized window coverings described above are depicted in the appended FIGs. and described below regarding the FIGs.

FIG. 1 depicts a venetian blind. The venetian blind 100 includes a top portion 101, a covering portion 102, and a bottom portion 103. The top portion includes a headrail 101*a*, a tilt rod 101*b*, a motor 101*c*, bobbins 101*d*, and manual control strings 101*e*. The tilt rod passes through the motor and the bobbins, connecting the motor to the bobbins. The control strings allow for winding of the bobbins and tilting of the bobbins. The covering portion includes slats 102*a* and support strings 102*b*. The strings connect the slats to the bobbins, thereby enabling tilting and raising/lowering of the slats. Wiring is also woven into the strings, the wiring electrically coupled to the motor. A battery is disposed within at least one of the slats and are electrically coupled to the motor via the wiring.

Figure 2:
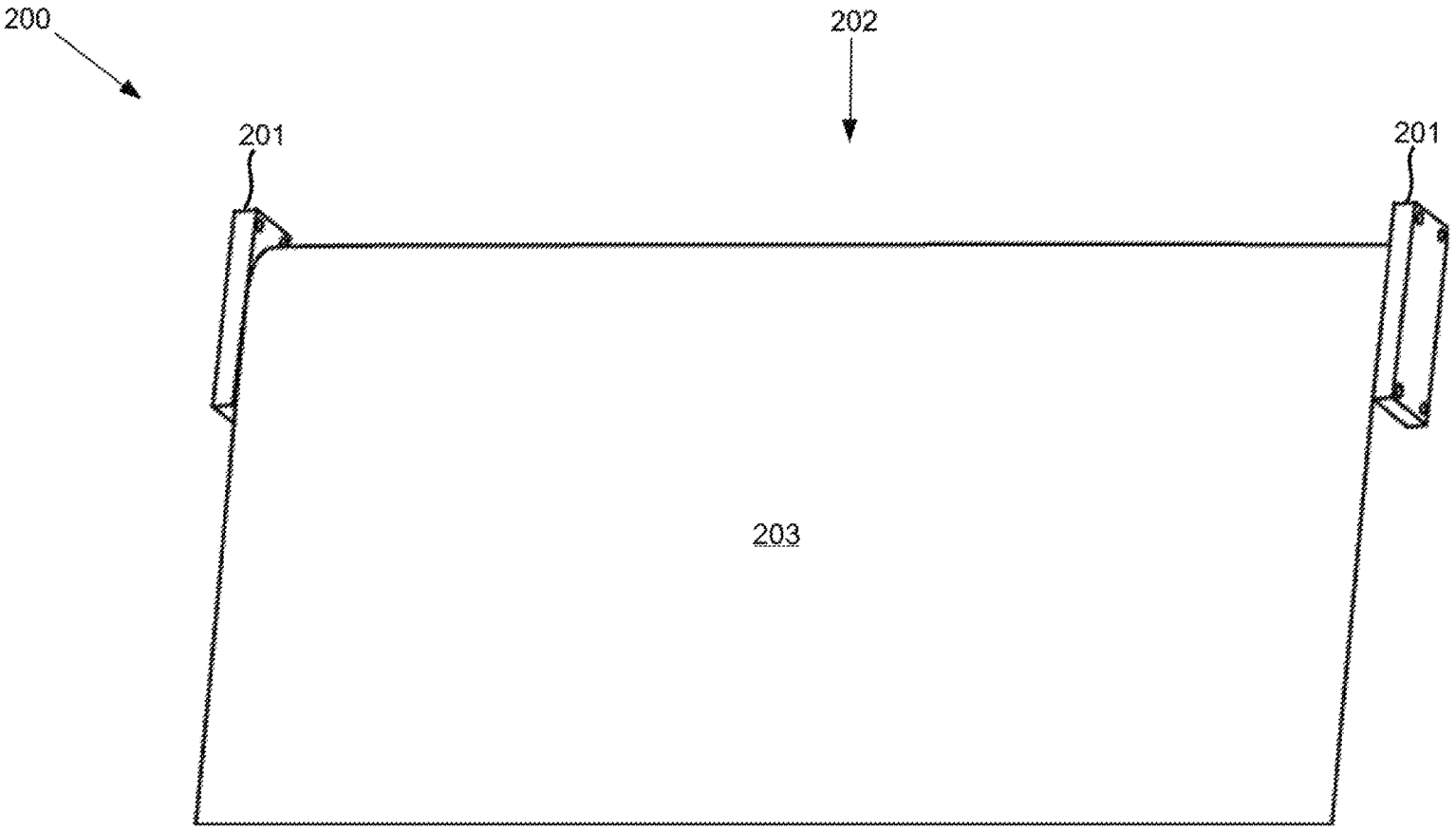
FIG. 2 depicts a roll-up window shade.

FIG. 2 depicts a roll-up window shade. The roll-up window shade 200 includes mounting brackets 201, a tube 202, and a flexible shade panel 203. A motor is fixed to at least one of the mounting brackets and is disposed in the tube. Battery cells and wiring are integrated into the shade panel and are electrically coupled to the motor via the wiring.

Figure 3A:
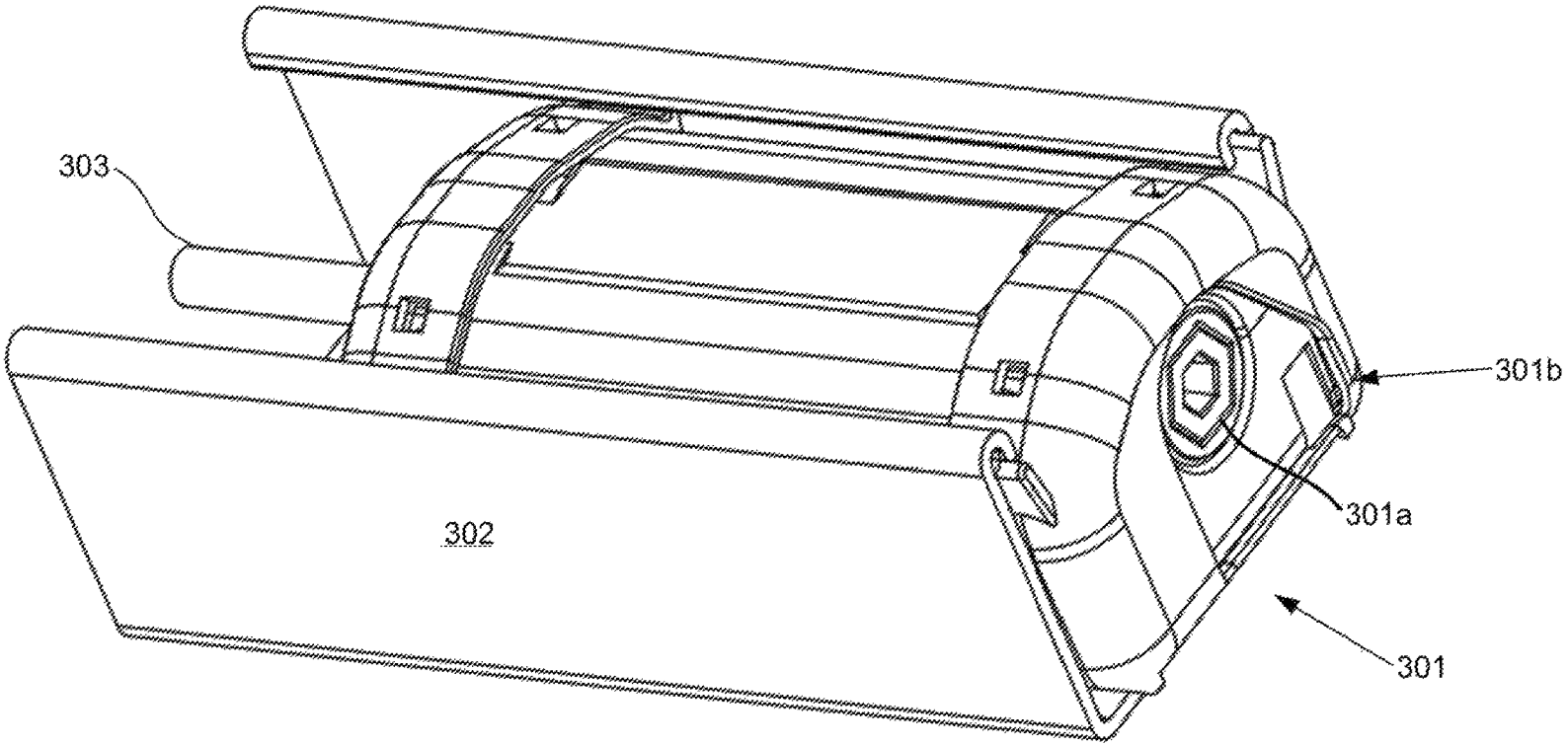
FIGS. 3A-B depict an example motor and gear assembly for use in the headrail of a motorized window covering.
Figure 3B:
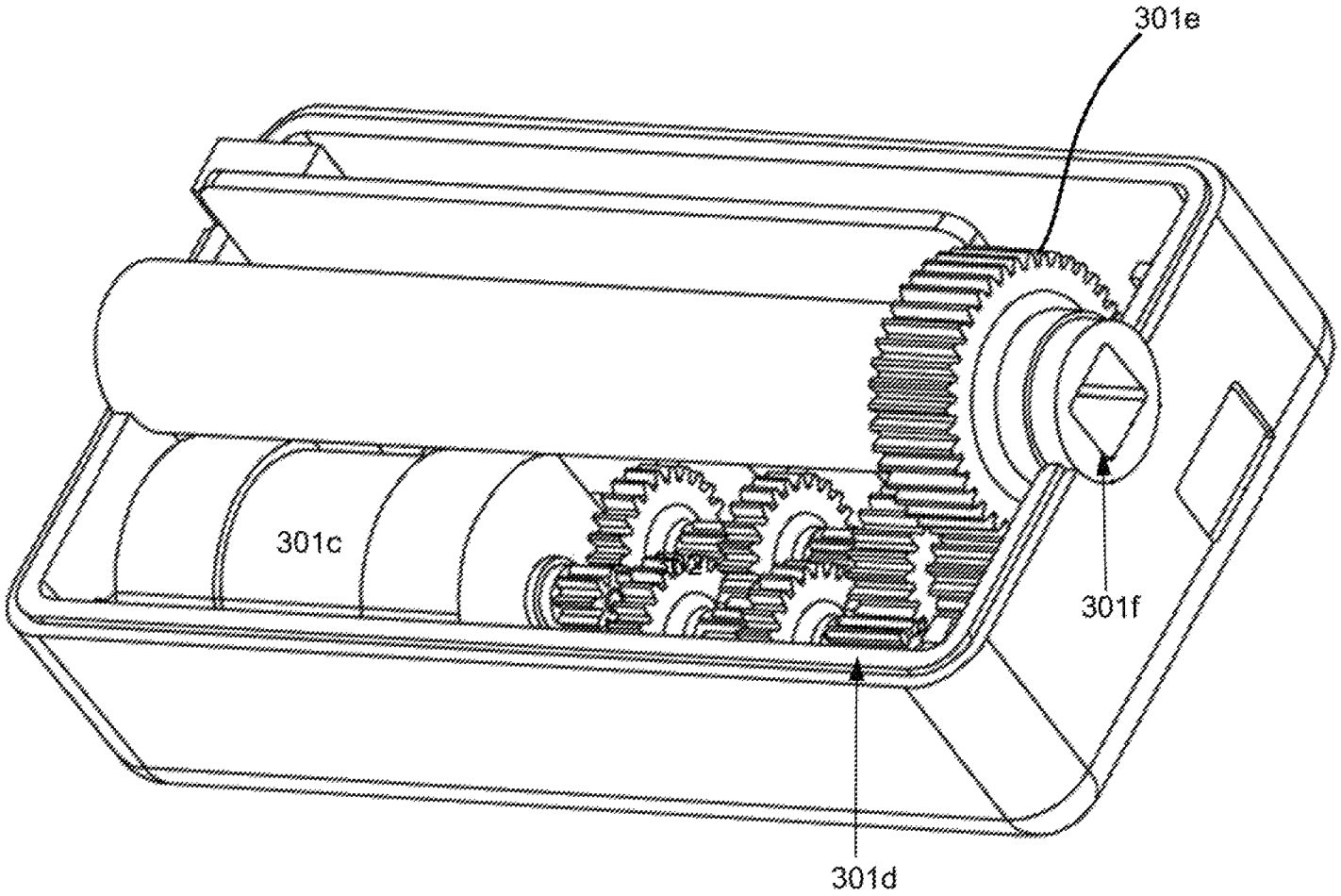

FIGS. 3A-B depict an example motor and gear assembly for use in the headrail of a motorized window covering. In FIG. 3A, the motor and gear assembly 301 is disposed within the headrail 302. A tilt rod 303 passes through the assembly in a channel 301*a*. The motor includes an electrical wiring port 301*b* that electrically couples the assembly to power and/or data. The headrail supports the assembly and enables the assembly to turn the tilt rod by providing a counter-force to the rotation of the assembly. In FIG. 3B, various internal components within the motor and gear assembly are illustrated. As shown, the motor and gear assembly includes a motor 301*c* and a power transmission system 301*d* having one or more stages of gears to reduce the gear ration of the motor. In certain embodiments, the gear ratio may be between 100:1 and 1000:1. The instant inventors have found that a gear ration of 720:1 (i.e., 720 turns of the motor 400 produces 1 turn of the output shaft 200) works well in the present application. As shown, the power transmission system drives a main gear 301*e* coupled to the output shaft 301*f*. The output shaft may, in turn, be used to drive the tilt rod (not shown). More detailed depictions of similar embodiments are found in U.S. Pat. No. 9,540,817 to David R. Hall et al., entitled "Motorized Gearbox Assembly with Through-Channel Design," particularly in FIGS. 3-5, and described in column 8 lines 1 to 65.

Figure 4:
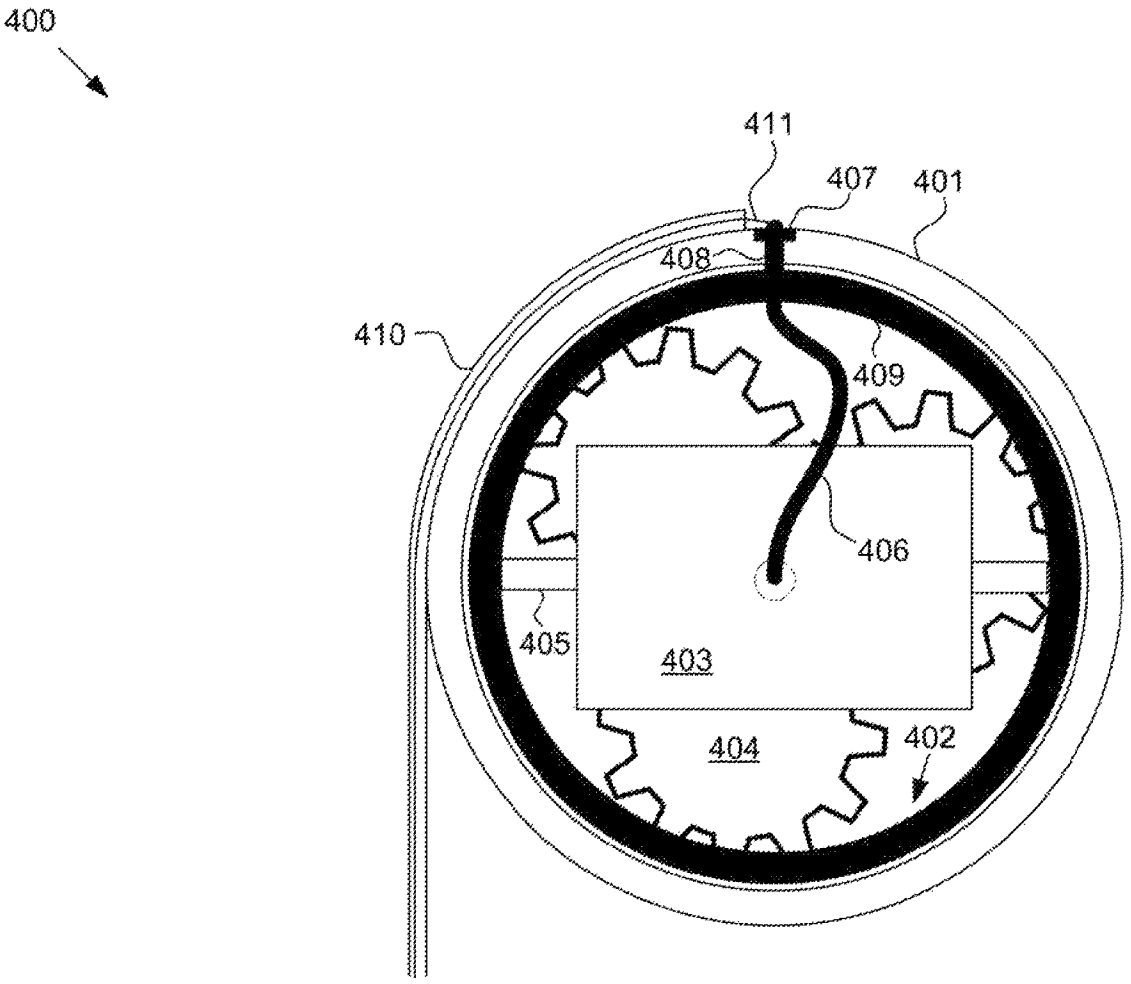
FIG. 4 depicts a side cross-section of a top portion of a roller shade.

FIG. 4 depicts a side cross-section of a top portion of a roller shade. The top portion 400 includes a rotatable tube 401, a fixed tube 402, a motor 403, a transmission 404, standoffs 405, a power line 406, a conductive strip 407, a conductive brush 408, a slip ring 409, a flexible panel 410 and wiring 411. The wiring is soldered to the conductive strip. The conductive strip is embedded in the rotatable tube. The conductive brush extends through the rotatable tube and contacts the slip ring. The slip ring is disposed in the rotatable tube. The power line is connected to the slip ring and the motor. The motor is supported by the standoffs, which are connected to the fixed tube. The transmission engages with the rotatable tube, allowing the motor to rotate the rotatable tube.

Figure 5:
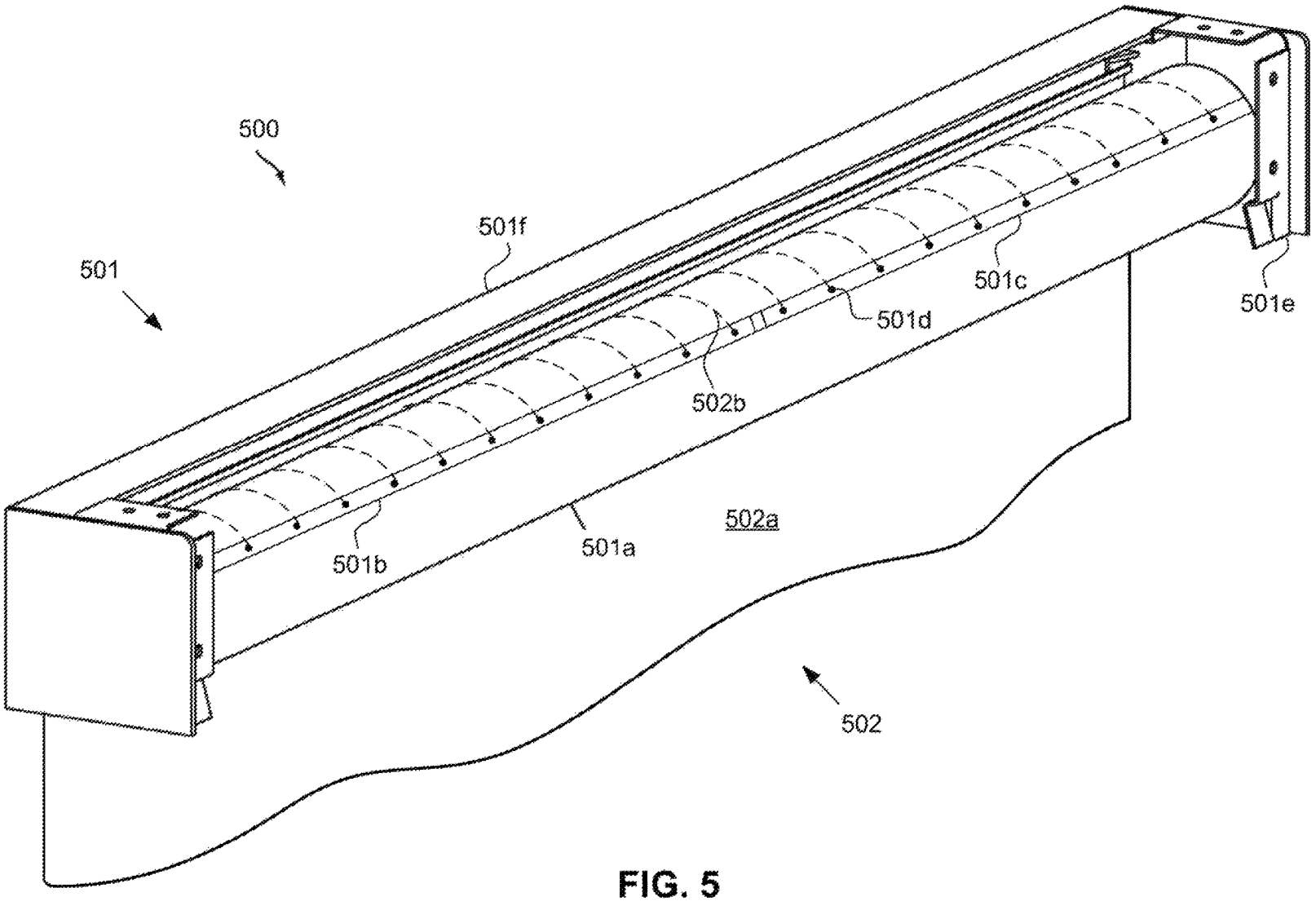
FIG. 5 depicts a portion of an unrolled roller shade.

FIG. 5 depicts a portion of unrolled roller shade. The roller shade 500 includes a top portion 501 and a covering portion 502. The top portion includes a tube 501*a*, left-side copper strip 501*b*, a right-side copper strip 501*c*, conductive grommets 501*d*, mounting brackets 501*e*, and a headrail 501*f*. The covering portion includes a flexible fabric panel 502*a* and wiring 502*b*. The wiring is woven into the flexible fabric panel. The panel is connected to the tube by the conductive grommets, and the wiring is fused to the grommets. The grommets are electrically coupled to the copper strips. The strips represent positive and negative sides of a circuit formed by the wiring and strips. The strips are coupled to conductors that pass through the tube to the motor. Although in the depicted embodiment power strips are shown, more conductive material may be included for data transmission, as well.

Figure 6:
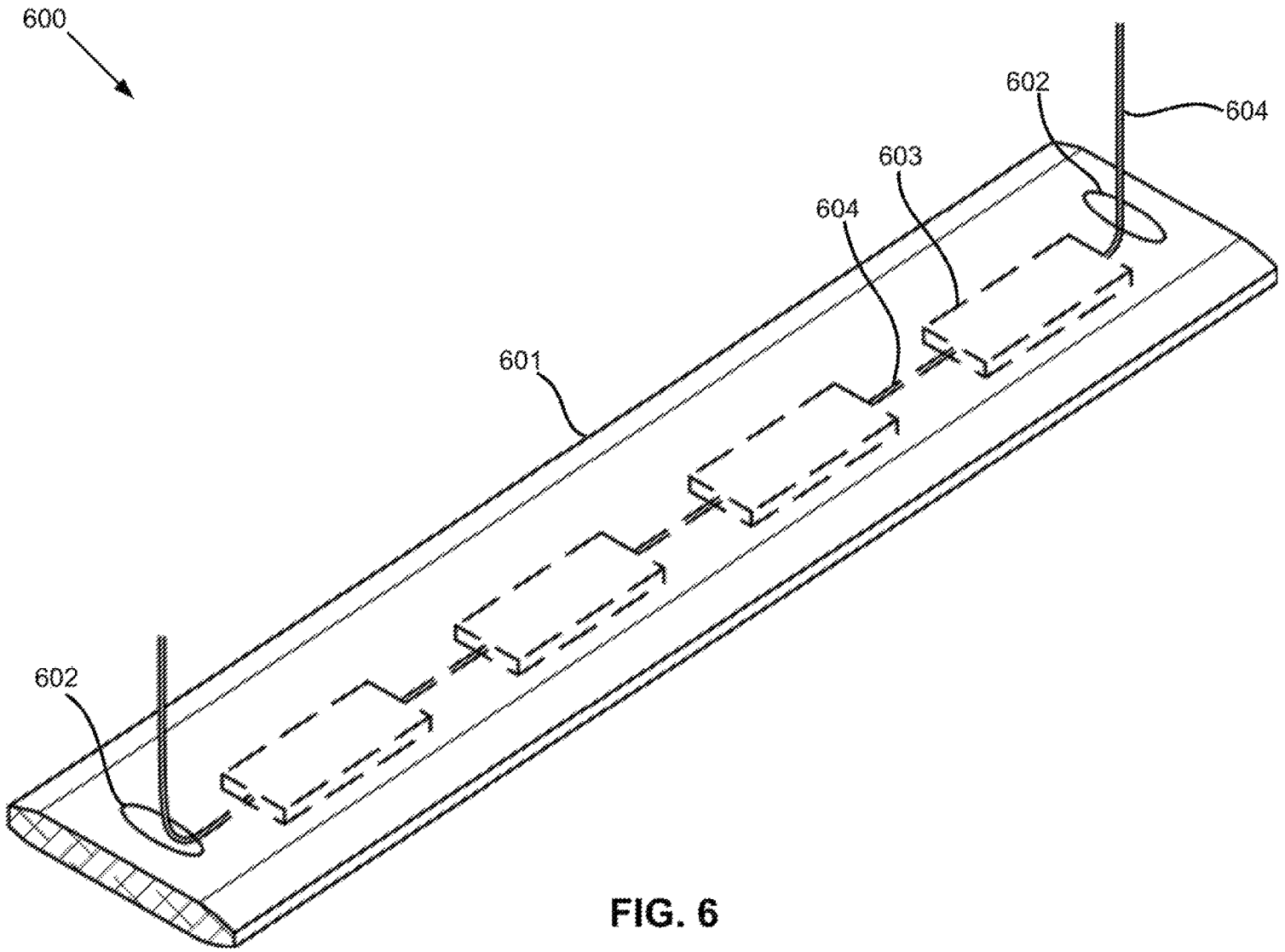
FIG. 6 depicts a view of a venetian blind slat with battery cells and wiring integrated into the slat.

FIG. 6 depicts a view of a venetian blind slat with battery cells and wiring integrated into the slat. The slat 600 includes a body 601, perforations in the body 602, battery cells 603, and wiring 604. The wiring connects the batteries and passes through the perforations.

Figure 7:
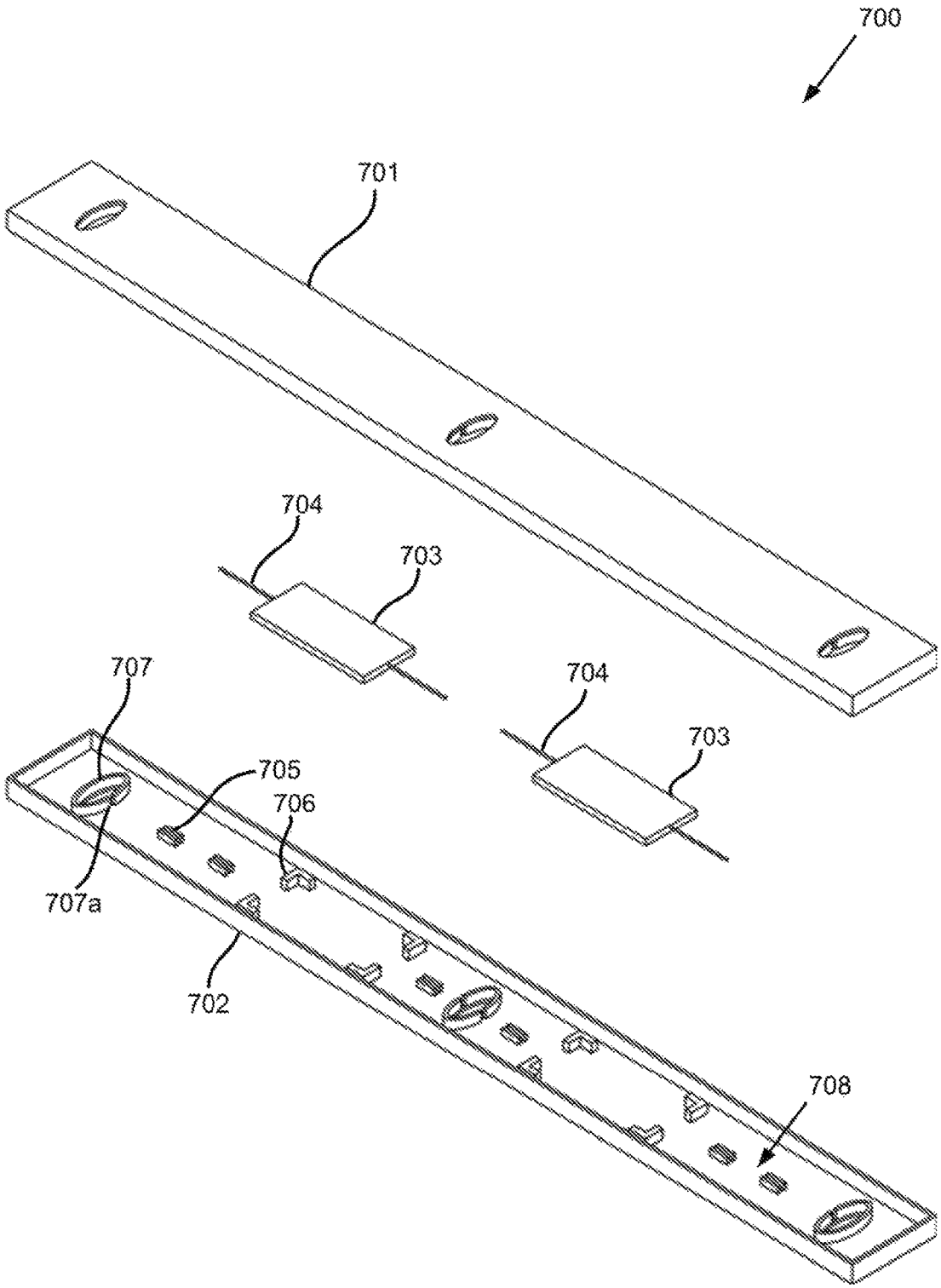
FIG. 7 depicts an exploded view of a venetian blind slat.

FIG. 7 depicts an exploded view of a venetian blind slat. The slat 700 includes a top body segment 701, a bottom body segment 702, battery cells 703, and wiring 704. The body segments include wire prongs 705, battery cell securing prongs 706, perforation ribs 707, and intra-cell interstices 708. The perforation ribs 707 each include cutouts 707*a* through which the wiring passes. The wiring may pass through the cutouts and out of the slat. The battery cell securing prongs hold the battery cells in place within the slat. The wire prongs hold the wiring in place within the slat. The top and bottom body segments may be adjoined by overlapping lip features in each (not shown), by an adhesive, and/or by heating each segment at the seam to meld the segments together and form a monolithic slat. In the depicted embodiment, the top and bottom body segments are comprised of injection-molded plastic.

Figure 8:
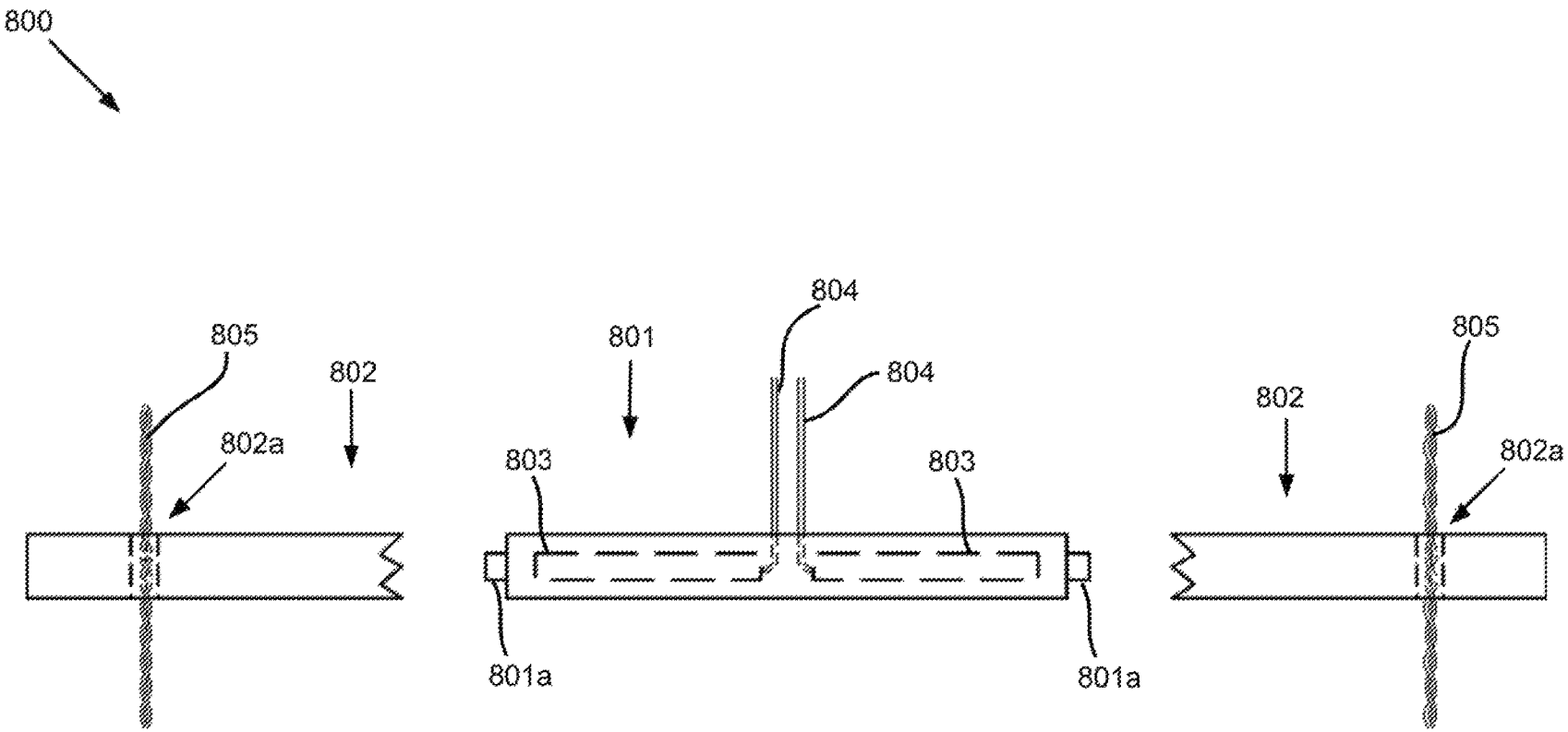
FIG. 8 depicts a partial side view of a segmented venetian blind slat.

FIG. 8 depicts a partial side view of a segmented venetian blind slat. The segmented slat 800 includes a center segment 801, two detachable end segments 802 extending from the center segment, battery cells 803, wiring 804, and support strings 805 passing through perforations 802*a* in the end segments. Only a portion of the end segments are shown. The center segment includes detent prongs 801*a* that insert into corresponding slots in the end segments (not shown) to connect the end segments to the center segment.

Figure 9A:
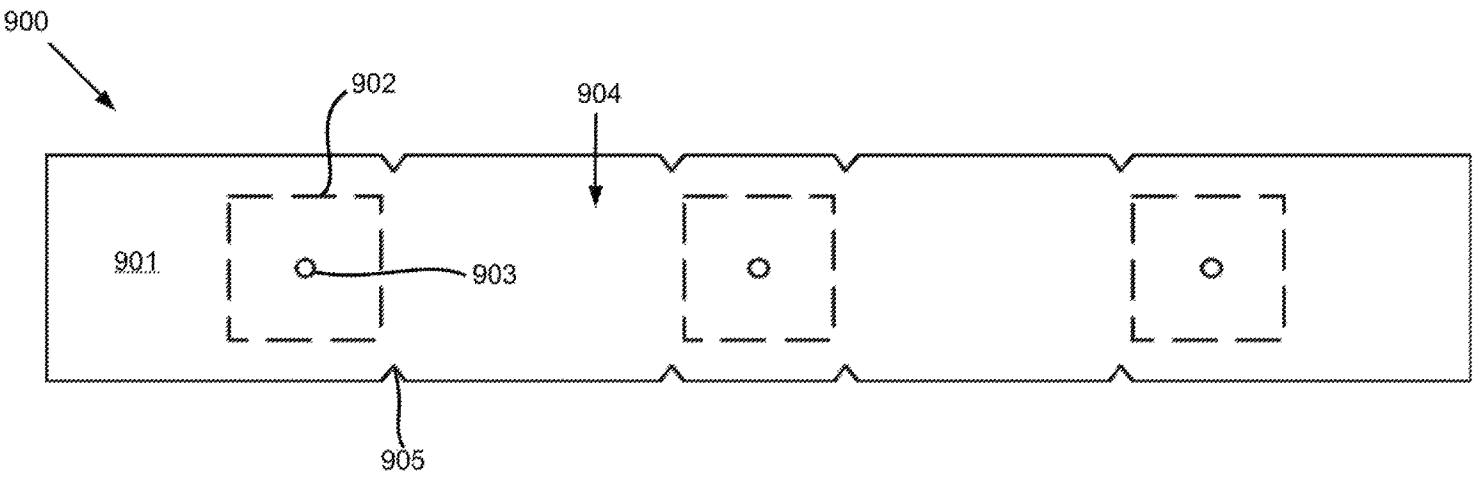
FIGS. 9A-B depict two views of a portion of a notched venetian blind slat.
Figure 9B:
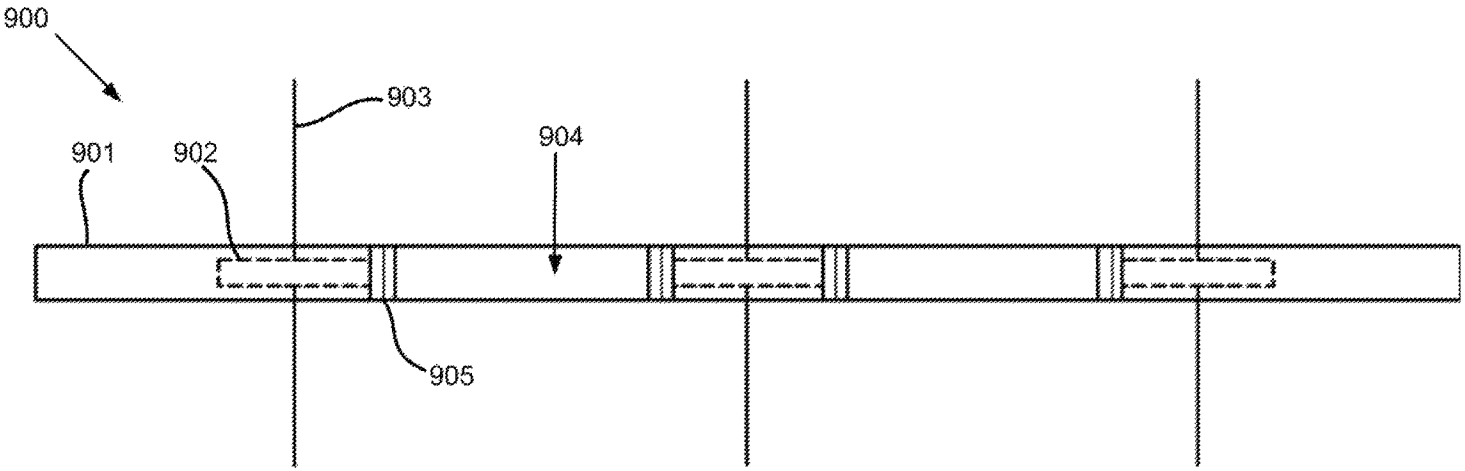

FIGS. 9A-B depict two views of a portion of a notched venetian blind slat. The slat 900 includes a body 901, battery cells 902, wiring 903, inter-cell interstices 904, and notches 905. The notches indicate to an installer the width of the interstices so that the installer knows where to cut and perforate, and not cut and not perforate, the slat during installation. The wiring extends vertically from the slats and is integrated into strings (not shown) that pass around and under the slat to support the slat.

Figure 10:
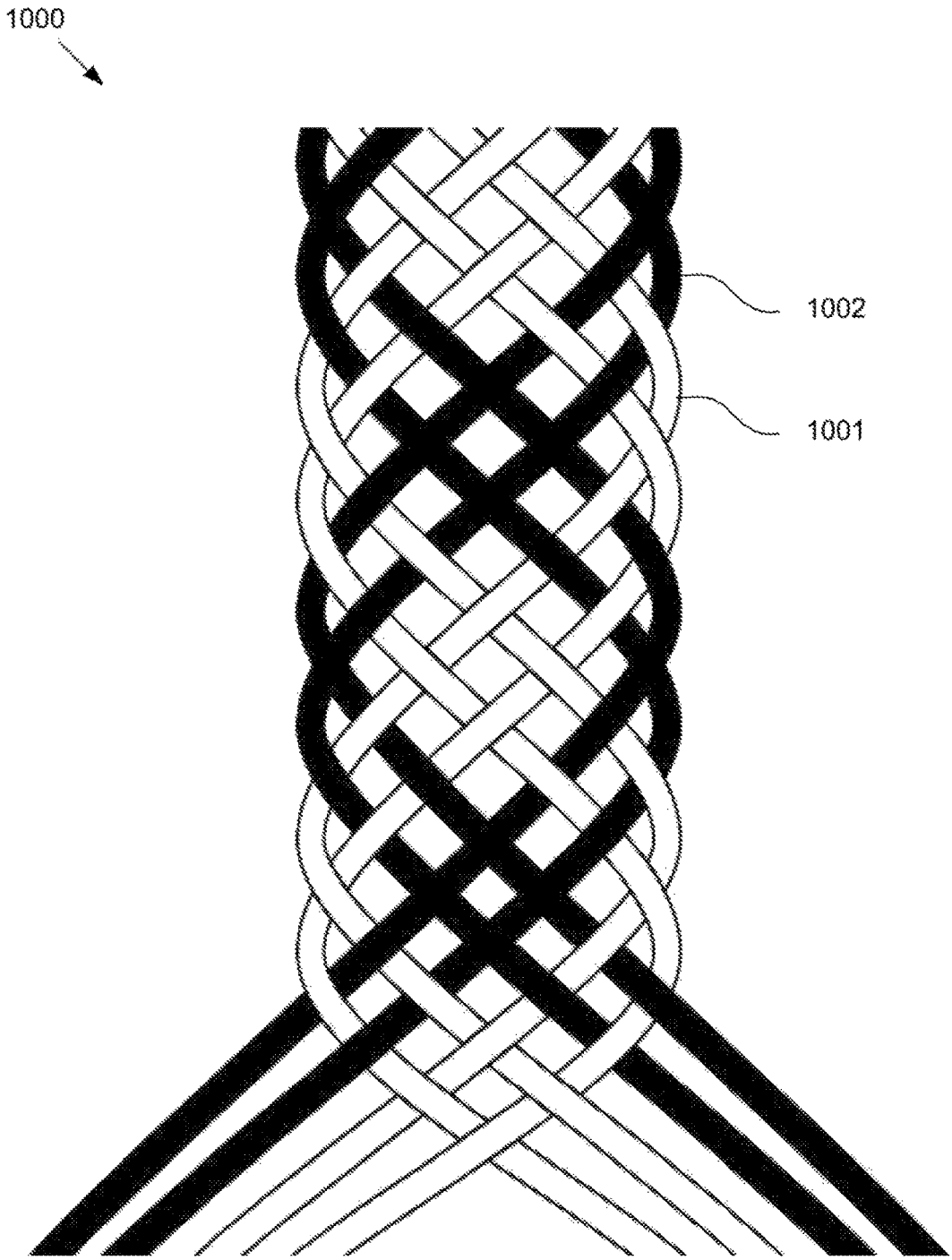
FIG. 10 depicts an embodiment of a venetian blind slat support string.

FIG. 10 depicts an embodiment of a venetian blind slat support string. The support string 1000 includes polymer strands 1001 and wiring 1002. The polymer strands and wiring are interwoven to form the string. Each wire includes a single-stranded copper core and a sheath. Each strand may include one or more polymer filaments.

Figure 11:
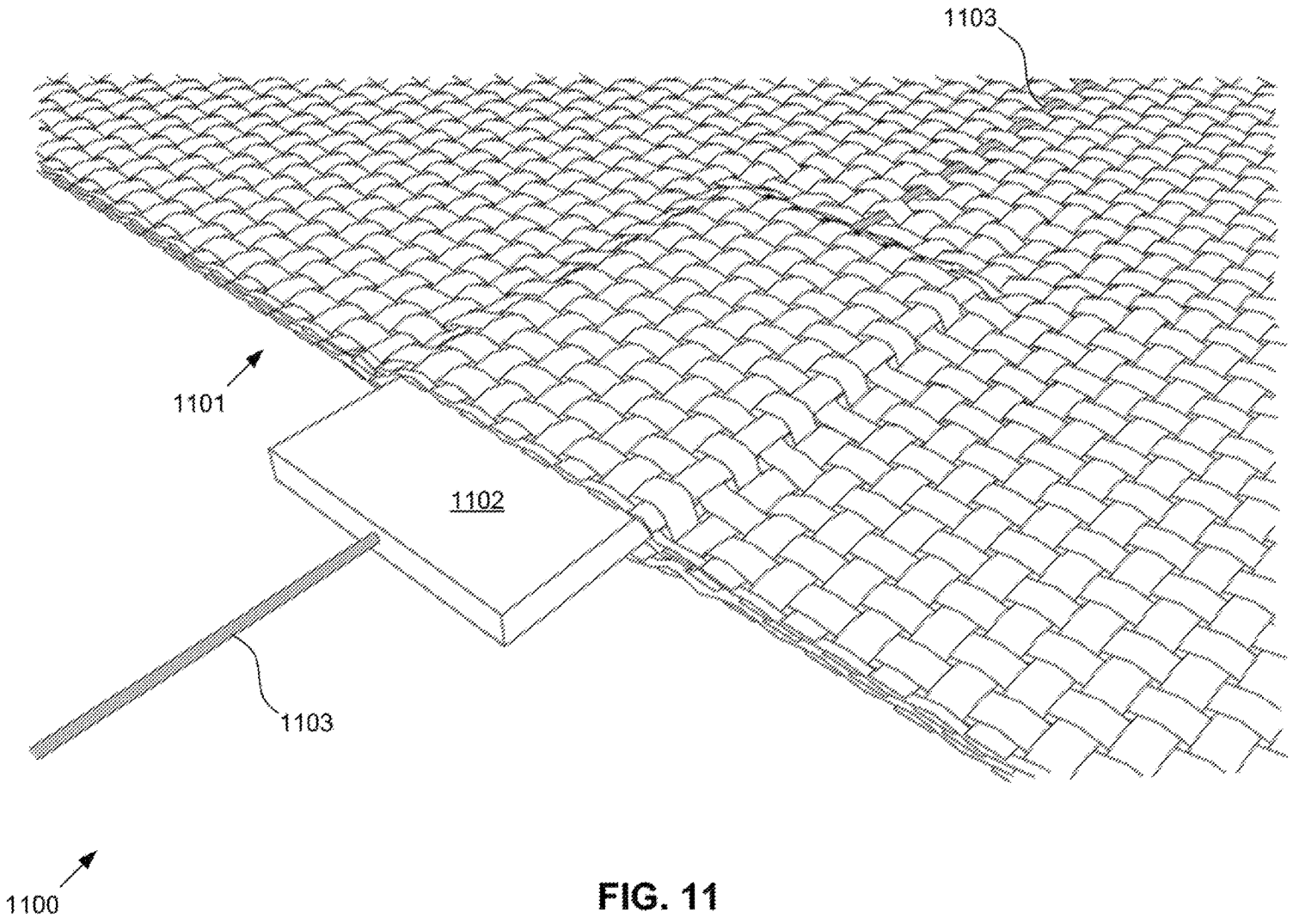
FIG. 11 depicts a partial view of a woven flexible shade panel for use in various roller shade embodiments.

FIG. 11 depicts a partial view of a woven flexible shade panel for use in various roller shade embodiments. The shade 1100 includes fibers 1101, a battery cell 1102, and wiring 1103. A portion of the fibers is cut away to show the wiring and the battery. The fibers are interwoven with each other and the wiring, and are woven around the battery cell.

Figure 12A:
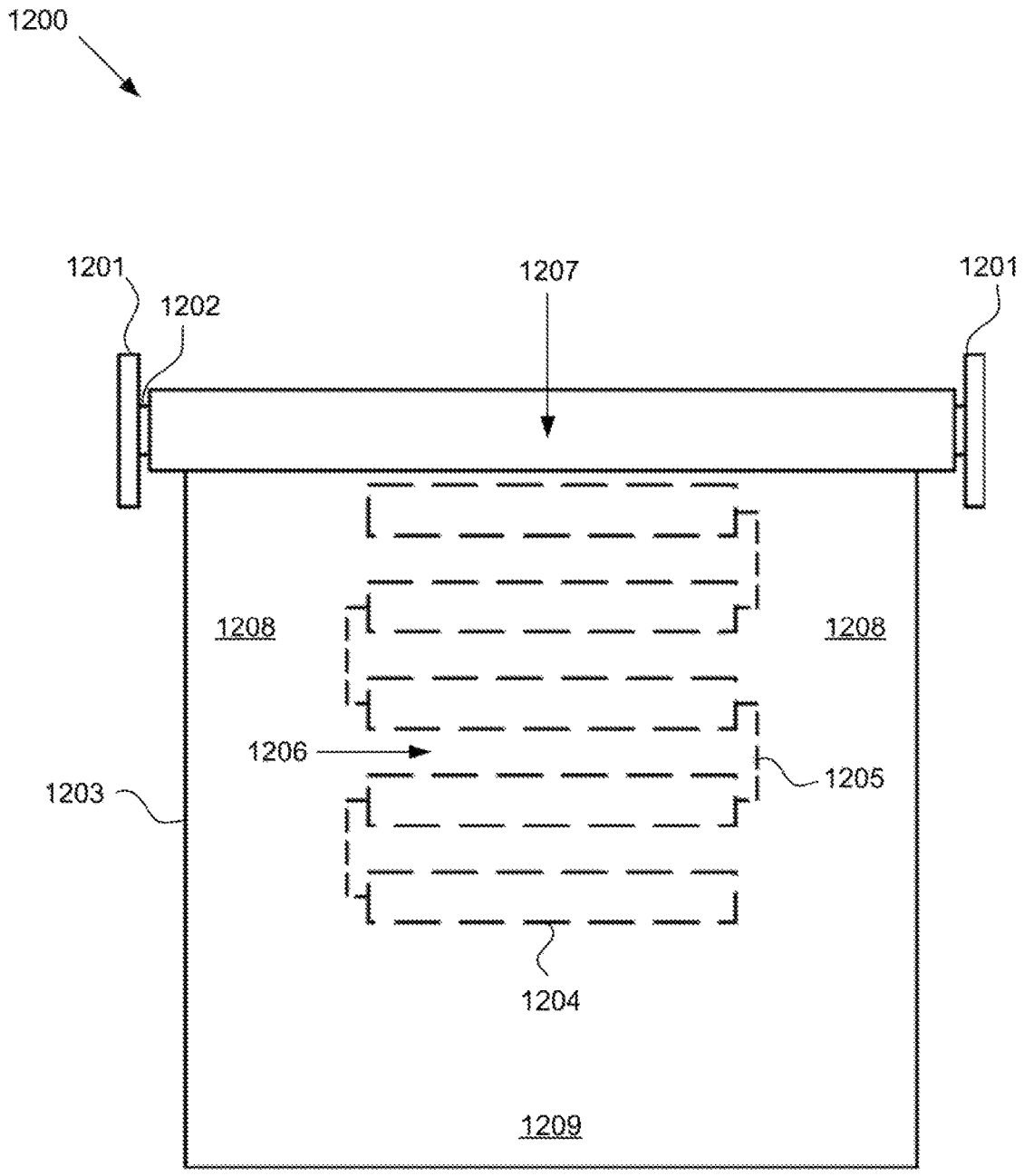
FIGS. 12A-E depict various alternative arrangements of battery cells integrated into a flexible shade panel of a roller shade.
Figure 12B:
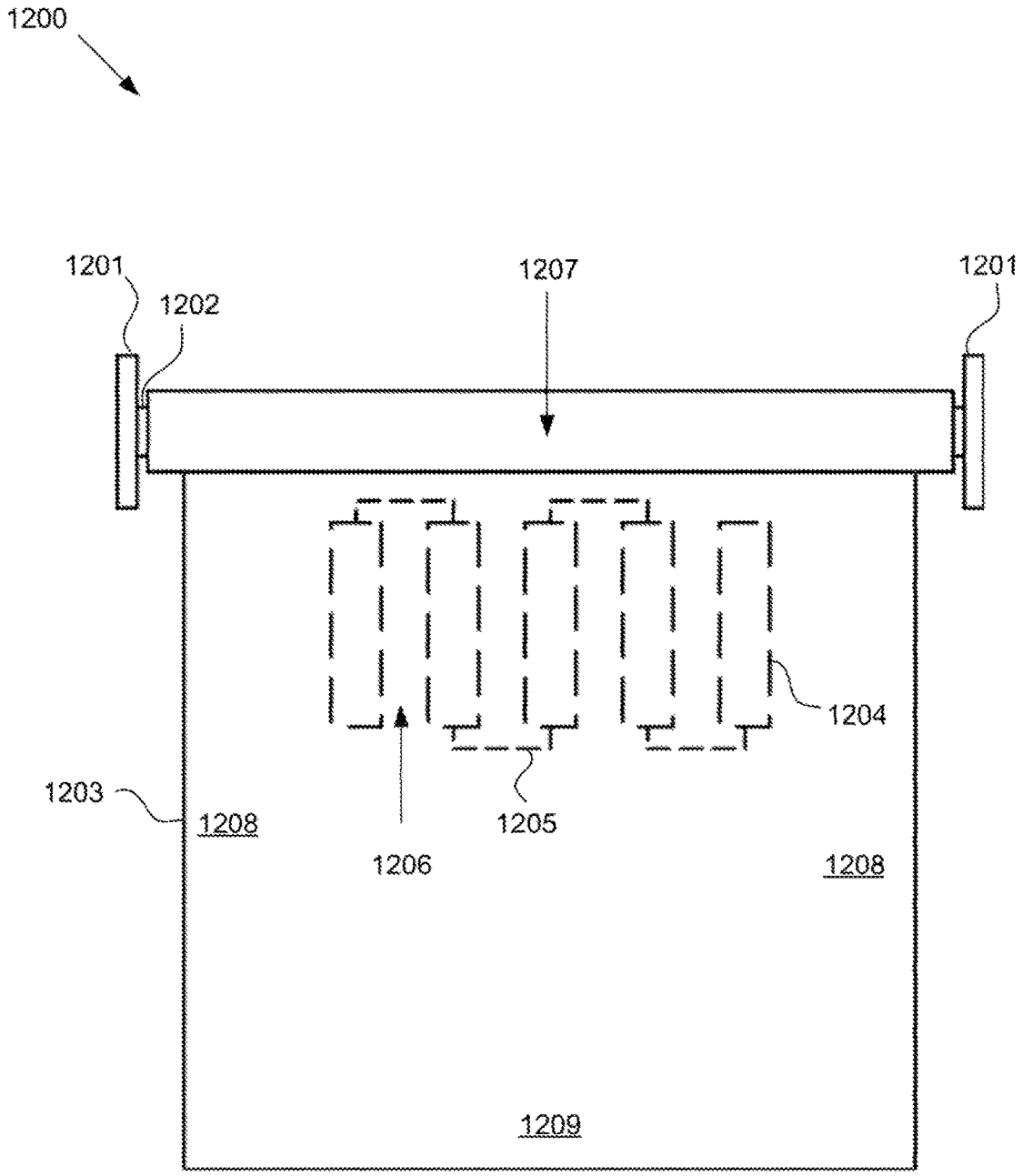
Figure 12C:
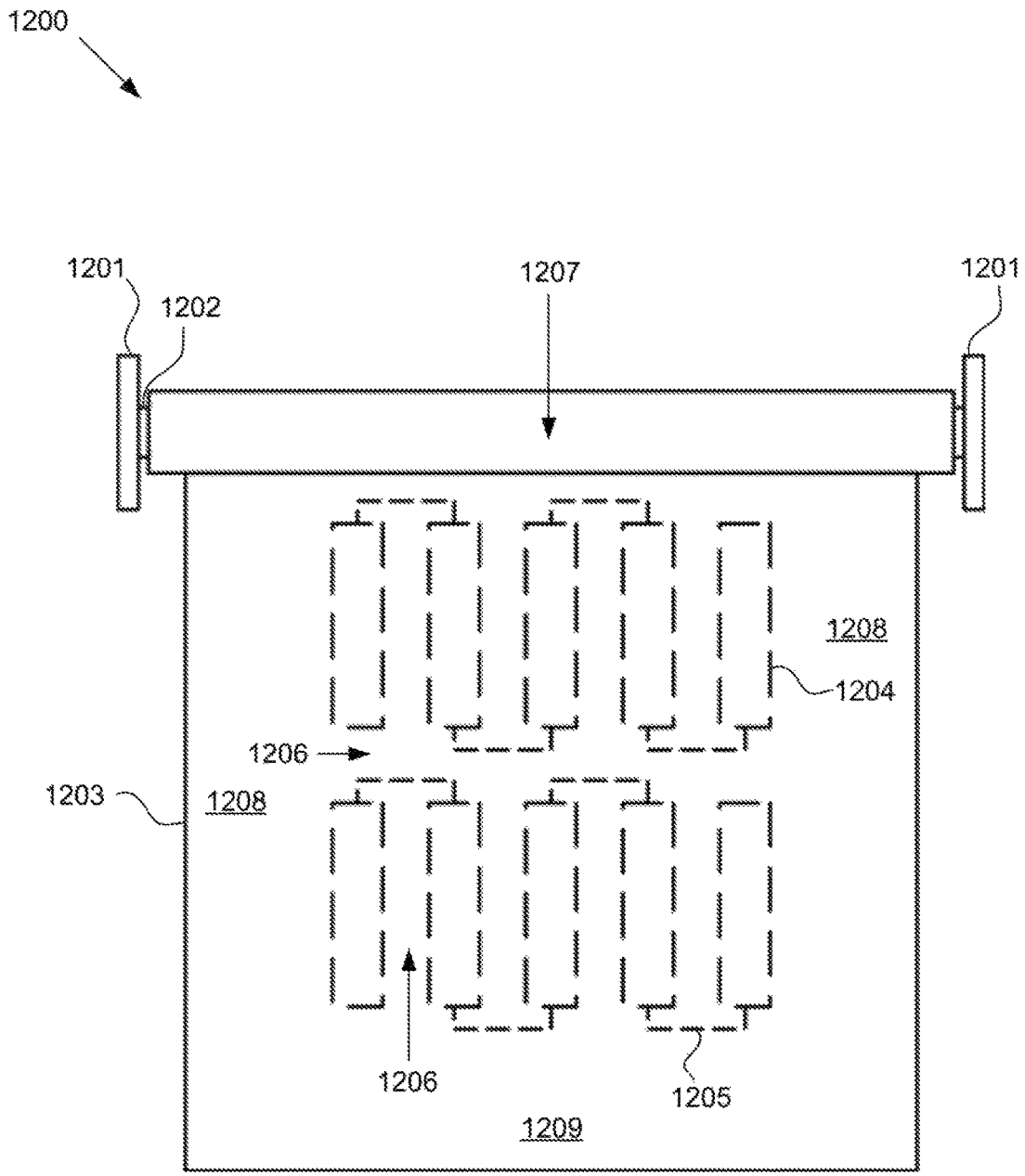
Figure 12D:
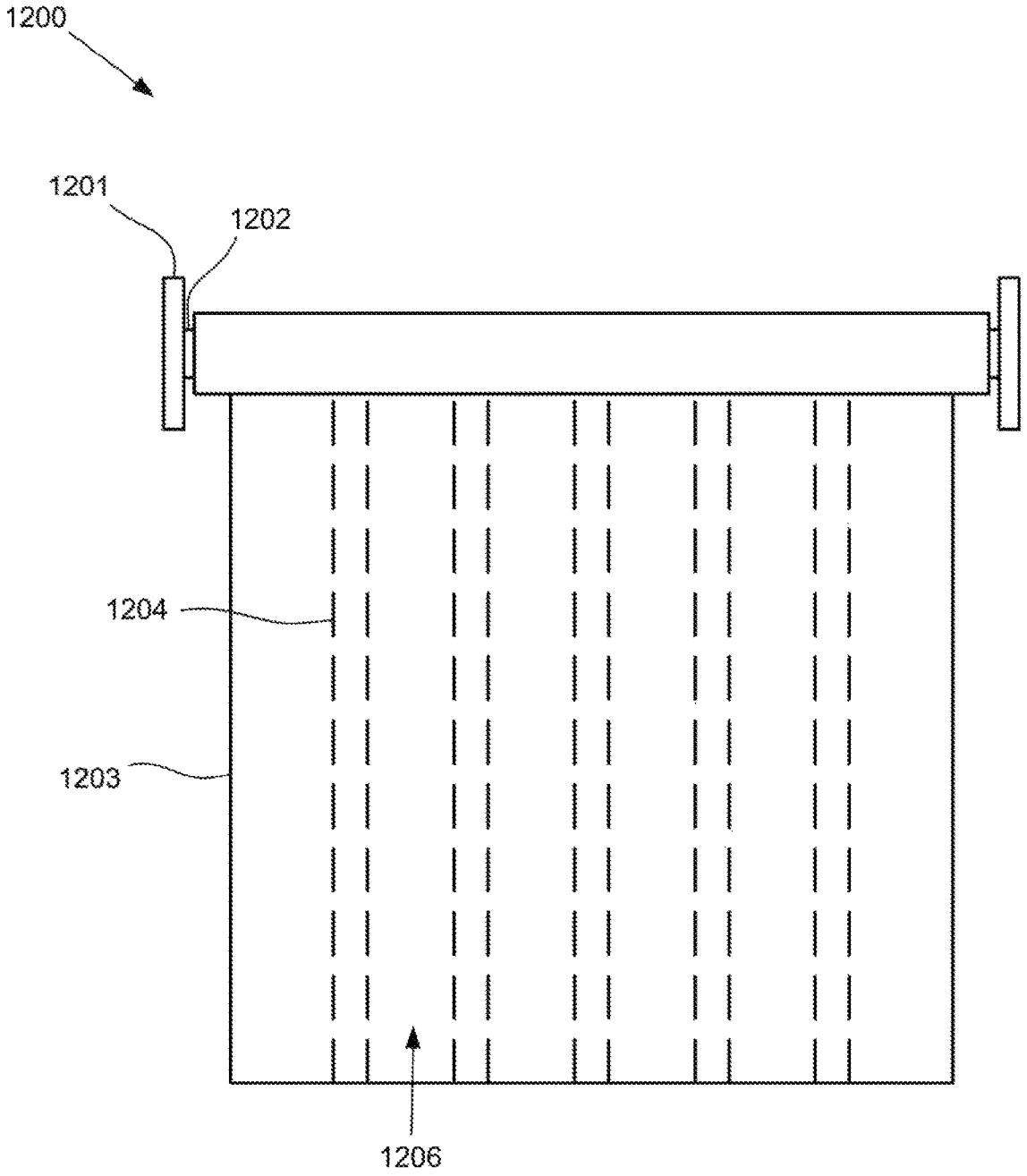
Figure 12E:
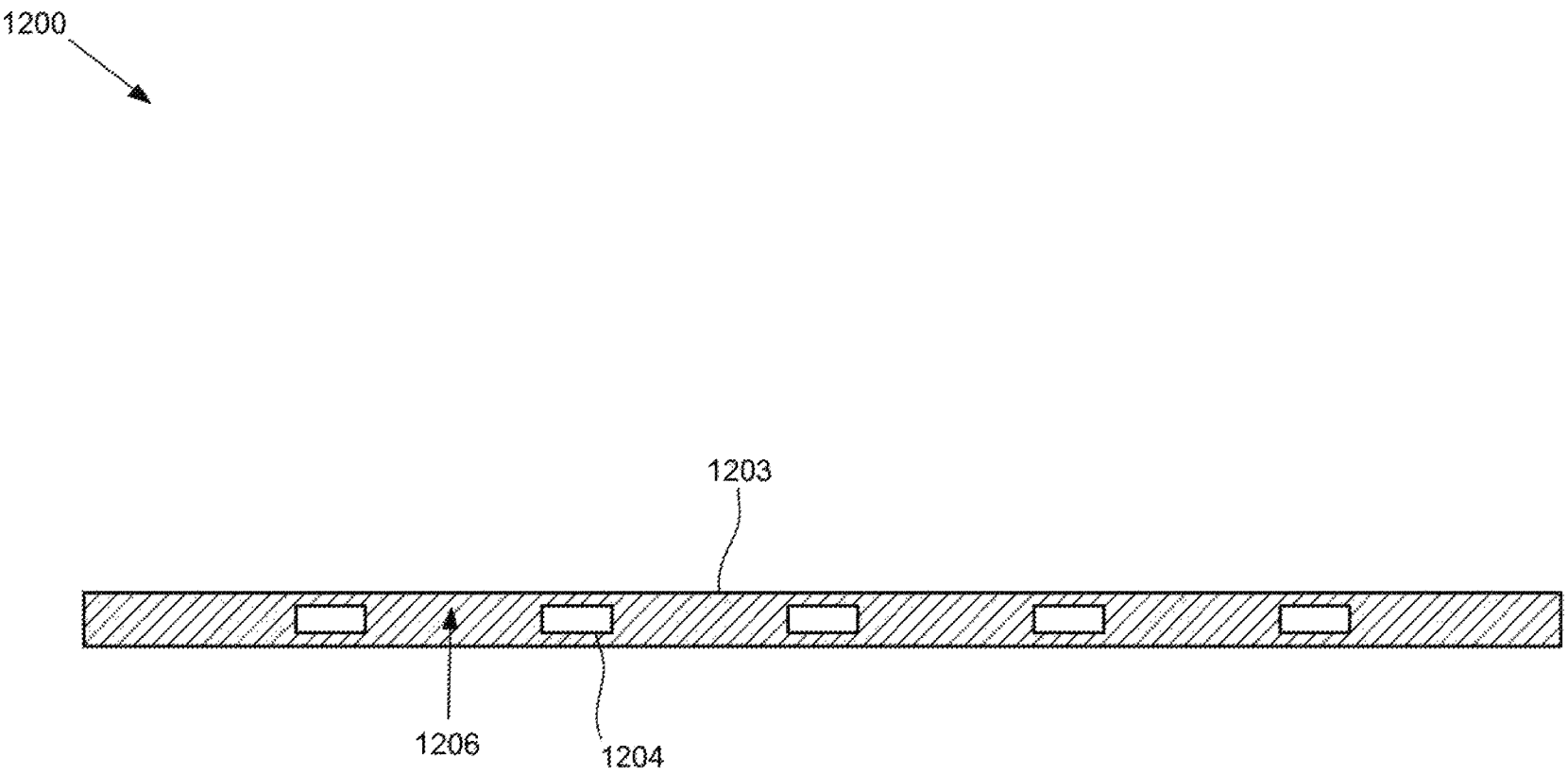

FIGS. 12A-E depict various alternative arrangements of battery cells integrated into a flexible shade panel of a roller shade. The roller shade 1200 includes mounting brackets 1201, a tube 1202, a flexible shade panel 1203, battery cells 1204, wiring 1205, and inter-cell interstices 1206. The battery cells and wiring are integrated into the flexible shade panel, and are thus shown with dotted lines. The wiring electrically couples the battery cells to a motor (not shown) disposed in the tube and affixed to one of the mounting brackets. The battery cells are aligned along a center segment 1207 of the flexible shade panel, leaving a bottom segment 1208 and two side segments 1209 free of battery cells. This may allow an installer to trim the flexible shade panel to fit a particular-sized window without cutting into the battery cells or the wiring. In FIG. 12A, the battery cells are aligned vertically and are connected in series to the motor. In FIG. 12B, the battery cells are aligned horizontally and are connected in series to the motor. In FIG. 12C, the battery cells are aligned horizontally and vertically. Two sets of battery cells are shown. Each battery cell within each set is connected to other battery cells within the same set in series, and the sets are connected to the motor in parallel. In FIG. 12D, the battery cells comprise flexible strips running along the length of the flexible shade from the top portion to the bottom portion. FIG. 12E is a cross-section of the flexible shade and flexible battery cell strips depicted in FIG. 12D.

Figure 13:
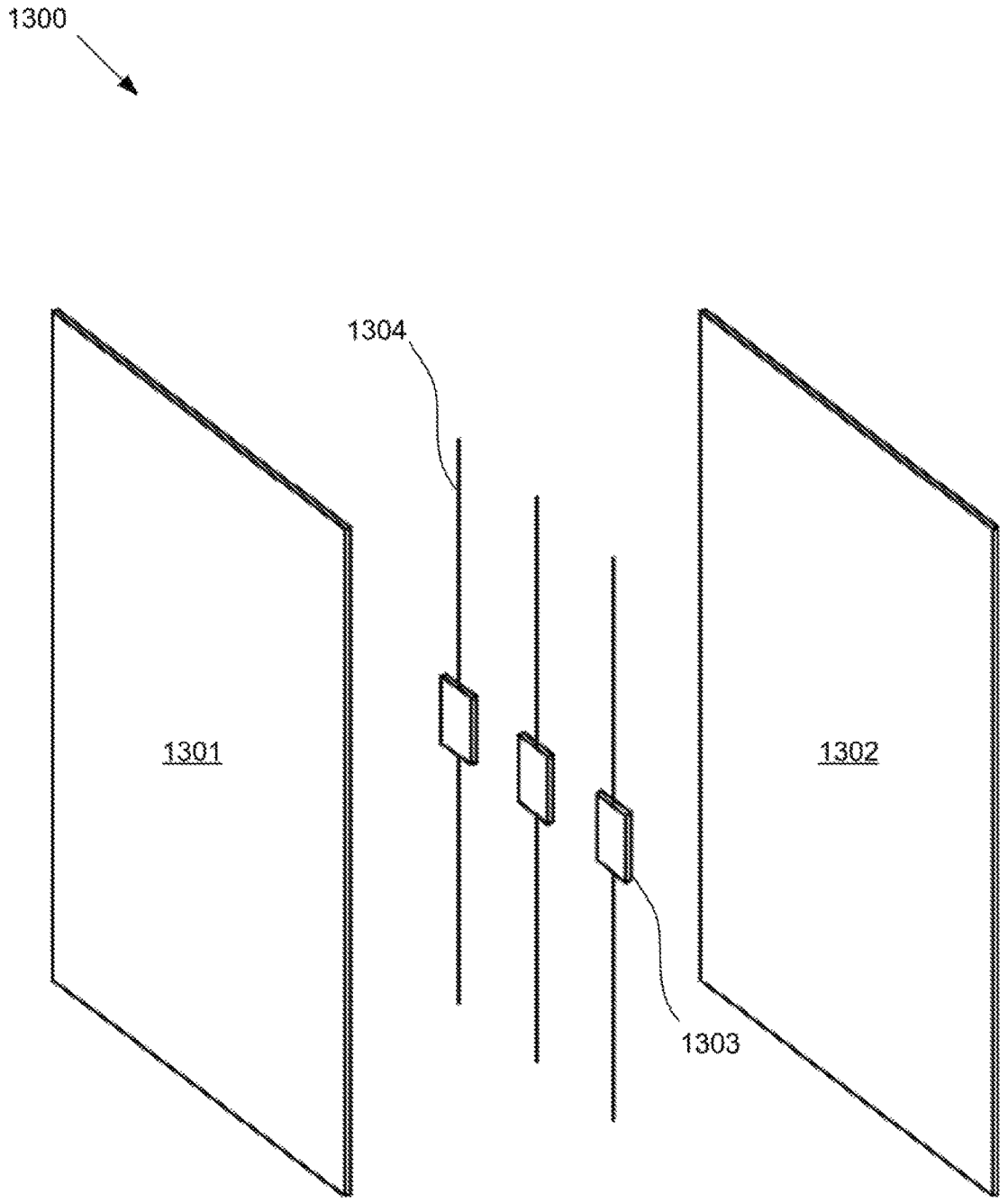
FIG. 13 depicts an exploded view of a flexible shade panel.

FIG. 13 depicts an exploded view of a flexible shade panel. The panel 1300 includes a front panel 1301, a back panel 1302, battery cells 1303, and wiring 1304. The battery cells and wiring are sandwiched between the two panels.

Figure 14:
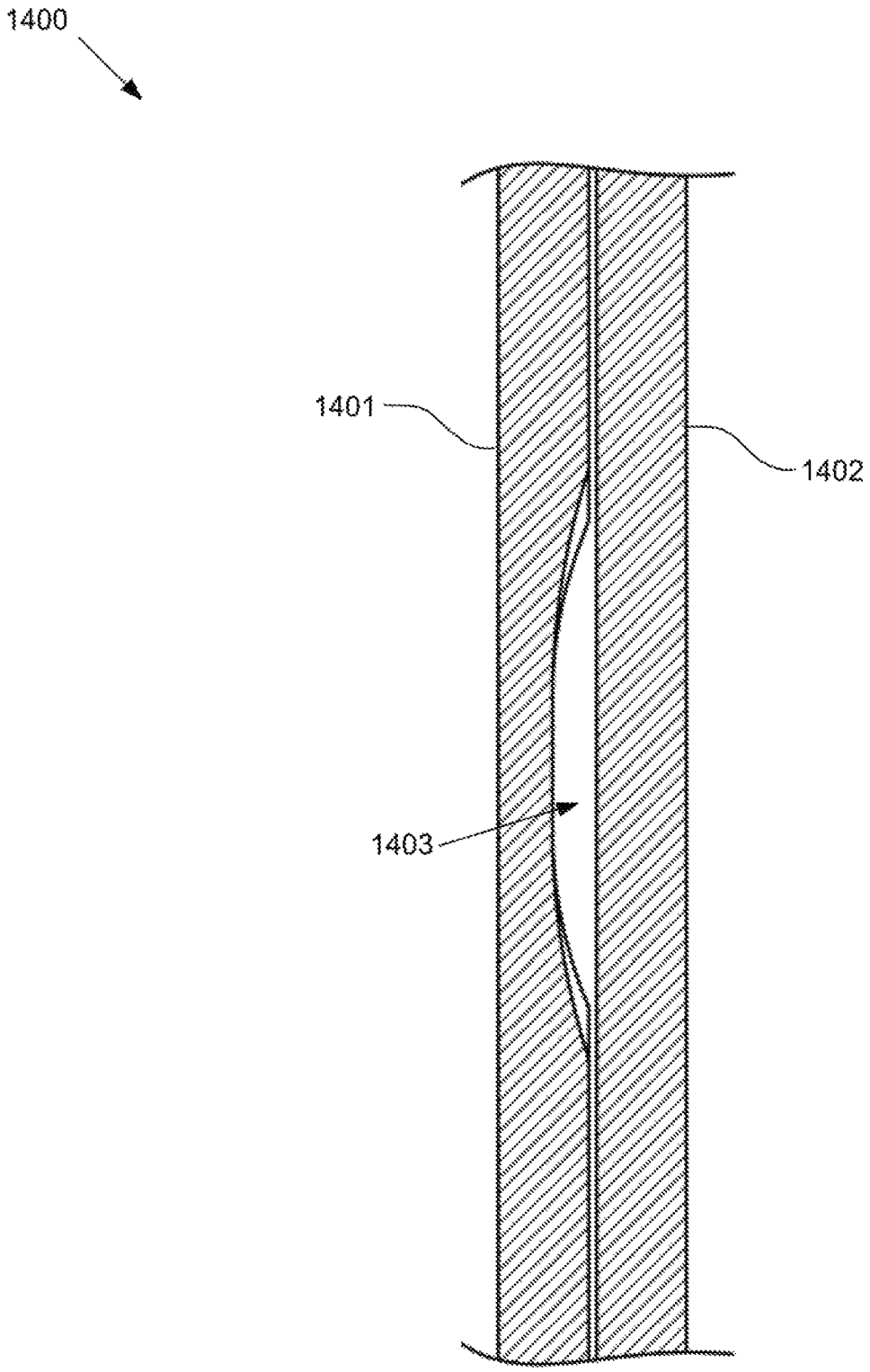
FIG. 14 depicts a section view of a portion of a flexible shade panel.

FIG. 14 depicts a section view of a portion of a flexible shade panel. The panel 1400 includes a front panel 1401, a back panel 1402, and a battery cell 1403. The battery cell is sandwiched between the two panels. The panels are thermoformed around the battery cell before the battery cell is charged and at a temperature below the battery cell's upper temperature tolerance. After the melded panels and battery cool, the battery may be charged.

We claim:

1. A motorized window covering, comprising:

a shade comprising an upper end and a lower end opposite the upper end;

a shade deployment assembly at the upper end that deploys the shade to cover a window, comprising:

a rotatable element connected to the shade that rotates to deploy and retract the shade;

a motor and gear assembly that rotates the rotatable element; and one or more mounting brackets that mount the deployment assembly to a surface;

a battery that powers the motor, the battery disposed in the shade between the upper end and the lower end; and wiring disposed in the shade and electrically coupling the battery to the motor.

2. The motorized window covering of claim 1, wherein the shade comprises a flexible panel.

3. The motorized window covering of claim 2, wherein the rotatable element comprises a roller tube, and wherein the motor and gear assembly are disposed within the tube.

4. The motorized window covering of claim 3, wherein the battery comprises a plurality of cells, and wherein the flexible panel comprises one or more interstices disposed between the cells, each interstice comprising a polymer.

5. The motorized window covering of claim 4, wherein one or more of the cells comprises a width ranging from 6 mm to 180 mm, wherein each interstice comprises a width at least twice a width of one of the plurality of cells.

6. The motorized window covering of claim 4, the flexible shade having a first thickness and a second thickness, the first thickness thicker than the second thickness, the first thickness ranging from 5 to 50 mils, and the second thickness ranging from 1 to 50 mils, wherein at least one of the cells is disposed in the flexible shade along the first thickness, and wherein at least one of the interstices is disposed in the shade along the second thickness.

7. The motorized window covering of claim 3, the cells horizontally adjacent each other, vertically adjacent each other, or both.

8. The motorized window covering of claim 7, the flexible panel further comprising wiring electrically coupling vertically-adjacent cells, horizontally-adjacent cells, or both.

9. The motorized window covering of claim 8, the flexible shade further comprising interstices between horizontally-adjacent cells, vertically-adjacent cells, or both.

10. The motorized window covering of claim 1, wherein the battery comprises an anode, a cathode, and an electrolyte, and wherein one or more of the anode and the cathode are comprised of one or more flexible materials.

11. The motorized window covering of claim 1, wherein shade comprises one or more horizontal slats, one or more vertical slats, or both, and wherein the battery is disposed in one or more of the slats.

12. The motorized window covering of claim 11, wherein the rotatable element comprises a tilt rod.

13. The motorized window covering of claim 12, further comprising one or more strings connecting adjacent slats, connecting one or more of the slats to the tilt rod, or both.

14. The motorized window covering of claim 13, wherein the wiring is integrated into at least one of the one or more strings.

15. The motorized window covering of claim 11, wherein the at least one window blind slat comprises perforations formed in the slat as the battery is incorporated into the slat.

16. The motorized window covering of claim 11, wherein the at least one window blind slat comprises perforations formed in the slat before the battery is charged, the charge having a voltage ranging from 0.1V to 12V.

17. The motorized window covering of claim 11, wherein the battery comprises a plurality of cells, and wherein the slat comprises one or more interstices disposed between neighboring cells.

18. The motorized window covering of claim 17, the slat comprising one or more markings corresponding to each of the one or more interstices, the markings indicating to a user one or more of a position and a width of each interstice.

19. The motorized window covering of claim 11, wherein the battery is disposed in a center segment of the at least one window blind slat, the slat further comprising one or more detachable end segments extending from the center segment.

20. The motorized window covering of claim 11, wherein the at least one window blind slat comprises a polymer, and wherein the polymer is rigid, the rigidity corresponding to a Young's Modulus greater than or equal to 5 GPa.

* * * * *